US007348953B1

(12) United States Patent
Satake

(10) Patent No.: US 7,348,953 B1
(45) Date of Patent: Mar. 25, 2008

(54) METHOD OF DRIVING LIQUID CRYSTAL DISPLAY DEVICE

(75) Inventor: Rumo Satake, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 0 days.

(21) Appl. No.: 09/716,885

(22) Filed: Nov. 20, 2000

(30) Foreign Application Priority Data

Nov. 22, 1999 (JP) ..... 11-331948

(51) Int. Cl.
*G09G 3/36* (2006.01)

(52) U.S. Cl. ..... 345/97; 345/89; 345/94; 345/95

(58) Field of Classification Search ..... 345/55–100; 349/76, 133, 136, 171, 172, 173, 174, 184, 349/100
See application file for complete search history.

(56) References Cited

U.S. PATENT DOCUMENTS 4,776,676 A * 10/1988 Inoue et al. ..... 345/97
4,840,462 A * 6/1989 Hartmann ..... 345/89
4,976,515 A * 12/1990 Hartmann ..... 349/173
5,214,523 A * 5/1993 Nito et al. ..... 349/173
5,349,367 A 9/1994 Wakita
5,400,048 A * 3/1995 Shimada et al. ..... 345/97
5,594,569 A 1/1997 Konuma et al. ..... 349/122
5,598,284 A * 1/1997 Kogushi et al. ..... 345/90
5,615,027 A 3/1997 Kuribayashi et al.
5,617,229 A * 4/1997 Yamamoto et al. ..... 349/172
5,643,826 A 7/1997 Ohtani et al. ..... 437/88
5,657,038 A * 8/1997 Okada et al. ..... 345/94
5,796,380 A 8/1998 Kurematsu ..... 345/96
5,847,799 A 12/1998 Tanaka et al. ..... 349/174
5,877,738 A 3/1999 Ito et al.
5,923,962 A 7/1999 Ohtani et al. ..... 438/150
5,953,002 A 9/1999 Hirai et al.
6,046,790 A 4/2000 Hara et al. ..... 349/172
6,057,824 A 5/2000 Katakura et al.
6,069,600 A * 5/2000 Saishu et al. ..... 345/87
6,069,604 A * 5/2000 Verhulst ..... 345/97

(Continued)

FOREIGN PATENT DOCUMENTS

EP 0 816 907 1/1998

(Continued)

OTHER PUBLICATIONS

English Abstract re Japanese Patent Application No. JP 9-050050, published Feb. 18, 1997.

(Continued)

*Primary Examiner*—David L. Lewis
(74) *Attorney, Agent, or Firm*—Cook, Alex, McFarron, Manzo, Cummings & Mehler, Ltd.

(57) ABSTRACT

A method of driving a liquid crystal display device is provided which can decrease the hysteresis of thresholdless liquid crystal and which can, depending on the liquid crystal, improve the response time. By providing a "0 V" reset period before or after a gradation display period, the hysteresis of the thresholdless liquid crystal is prevented. With regard to a liquid crystal which has a small spontaneous polarization and with which switching between halftones takes a lot of time, there is an effect of improving the response time by switching via "0 V".

41 Claims, 22 Drawing Sheets

U.S. PATENT DOCUMENTS

| | | | | |
|---|---|---|---|---|
| 6,122,034 | A | 9/2000 | Tanaka et al. | 349/174 |
| 6,139,927 | A * | 10/2000 | Takao et al. | 349/133 |
| 6,163,360 | A * | 12/2000 | Tanaka et al. | 345/97 |
| 6,219,019 | B1 * | 4/2001 | Hasegawa et al. | 345/96 |
| 6,239,779 | B1 * | 5/2001 | Furuya et al. | 345/87 |
| 6,292,183 | B1 | 9/2001 | Yamazaki et al. | 345/211 |
| 6,323,850 | B1 | 11/2001 | Katakura et al. | 345/204 |
| 6,339,416 | B1 * | 1/2002 | Kondoh | 345/97 |
| 6,392,624 | B1 * | 5/2002 | Yang et al. | 345/94 |
| 6,417,828 | B1 * | 7/2002 | Sato et al. | 345/97 |
| 6,545,656 | B1 | 4/2003 | Yamazaki | 345/94 |
| 2002/0109659 | A1 | 8/2002 | Hiroki | |

FOREIGN PATENT DOCUMENTS

| | | |
|---|---|---|
| JP | 06 194623 | 7/1994 |
| JP | 07-130652 | 5/1995 |
| JP | 9-050050 | 2/1997 |
| JP | 10-073803 | 3/1998 |
| JP | 10-082985 | 3/1998 |
| JP | 10-301091 | 11/1998 |
| JP | 11-231286 | 8/1999 |

OTHER PUBLICATIONS

English Abstract re Japanese Patent Application No. JP 10-073803, published Mar. 17, 1998.

English Abstract re Japanese Patent Application No. JP 10-082985, published Mar. 31, 1998.

English Abstract re Japanese Patent Application No. JP 10-301091, published Nov. 13, 1998.

English Abstract re Japanese Patent Application No. JP 11-231286, published Aug. 27, 1999.

JP 11-231286 English full translation.

Chandani et al., "Effect of Alignment Layer on V-Shaped Switching in a Chiral Smectic Liquid Crystal," *Liquid Crystals*. vol. 25, LCT 100975, 1998, pp. 1-13.

U.S. Appl. No. 10/385,151, (pending) to Yamazaki filed Mar. 10, 2003, including specification, abstract, claims, drawings and PTO filing receipt.

Yoshida, T. et al, "A Full-Color Thresholdless Antiferroelectric LCD Exhibiting Wide Viewing Angle with Fast Response Time," SID 97 Digest, pp. 841-844, (1997).

Furue, H. et al, "Characteristics and Driving Scheme of Polymer-Stabilized Monostable FLCD Exhibiting Fast Response Time and High Contrast Ratio with Gray-Scale Capability," SID 98 Digest, pp. 782-785, (1998).

* cited by examiner

DRIVING WAVEFORM

DRIVING RESULT

DRIVING WAVEFORM AND DRIVING RESULT
WHEN "OV" RESET PERIOD IS NOT PROVIDED

DRIVING WAVEFORM AND DRIVING RESULT
WHEN "OV" RESET PERIOD IS NOT PROVIDED

DRIVING WAVEFORM AND DRIVING RESULT
WHEN "OV" RESET PERIOD IS SHORT
RESET PERIOD: 2msec GRADATION DISPLAY PERIOD: 14.6msec

DRIVING WAVEFORM

DRIVING RESULT

DRIVING WAVEFORM AND DRIVING RESULT
WHEN RESET VOLTAGE OF "1V" IS PROVIDED

THIN

THICK

ORIENTATION FILM THICKNESS

SMALL

LARGE

SPONTANEOUS POLARIZATION

CHARACTERISTICS OF HYSTERESIS OF THRESHOLDLESS LIQUID CYRSTAL

DRIVING WAVEFORM AND DRIVING RESULT
WHEN "OV" RESET PERIOD IS PROVIDED
SPONTANEOUS POLARIZATION OF LIQUID CRYSTAL: 40 nC/cm$^2$

RESPONSE TIME BETWEEN POSITIVE POLARITY VOLTAGES

RESPONSE TIME BETWEEN NEGATIVE POLARITY VOLTAGES

RESPONSE TIME BETWEEN OPPOSITE POLARITY VOLTAGES

OPTICAL RESPONSE OF THRESHOLDLESS LIQUID CRYSTAL WHEN "0V" RESET PERIOD IS NOT PROVIDED

OPTICAL RESPONSE OF THRESHOLDLESS LIQUID CRYSTAL WHEN "0V" RESET PERIOD IS PROVIDED

THICKNESS OF ORIENTATION FILM: 30nm

THICKNESS OF ORIENTATION FILM: 75nm

THICKNESS OF ORIENTATION FILM: 110nm

THICKNESS OF ORIENTATION FILM: 220nm

THICKNESS OF ORIENTATION FILM: 30nm

THICKNESS OF ORIENTATION FILM: 75nm

THICKNESS OF ORIENTATION FILM: 110nm

THICKNESS OF ORIENTATION FILM: 220nm

METHOD OF DRIVING LIQUID CRYSTAL DISPLAY DEVICE

BACKGROUND OF THE INVENTION

1. Field of the Invention

In the present specification, the term "liquid crystal display device" means a display device that changes the polarization, scattering, or wavelength characteristics of an incident light into a liquid crystal material to display brightness and darkness thereof by means of applying a voltage to the liquid crystal.

In the present specification, the term "thresholdless liquid crystal", "V-shaped liquid crystal", or "liquid crystal having a chiral smectic $C_R$ phase" means a liquid crystal having no clear threshold due to remarkably occurring phase transition precursor phenomenon. The above-mentioned liquid crystal has such characteristics that, when voltages of positive polarity and negative polarity the absolute values of which are the same, are applied thereto, the tilt angles at the voltages are the same, and the transmittance is uniquely determined.

In the present specification, the term "active element" means an element that controls electric power from an external power source according to an input signal. An active element includes a thin film transistor, a field-effect transistor, and a diode.

In the present specification, the term "thin film transistor" means a semiconductor element that has a semiconductor layer, a gate electrode, a source electrode, and a drain electrode.

The present invention relates to a method of driving liquid crystal having spontaneous polarization, which can decrease hysteresis, which is specific to thresholdless liquid crystal material having no clear threshold and being capable of halftone display, thereby being capable of performing satisfactory gradation display, and simultaneously shortening the response time.

2. Description of the Related Art

A liquid crystal panel has advantages of thinness, lightness in weight, and low power consumption, and is now used in a display device such as a portable TV, a wall-hung TV, or the like, which is required to respond at high speed on the level of a dynamic image. Further, since display on a large-sized screen is possible, a liquid crystal panel can also be used as a projector panel such as of a 50-inch rear projector.

As a liquid crystal orientation mode, a TN mode with the cell gap being about 4-5 μm is commonly used since the orientation can be easily controlled in that mode. However, in the TN mode, since an orientation restraining force of an orientation film is strong, the response time is slow in halftone display which is close to a white level. Therefore, in dynamic image display at high speed, the liquid crystal material can not respond timely, which leads to flicker.

Technology for shortening the response time using nematic liquid crystal material instead of the TN mode includes a HAN mode, an OCB mode, a TN mode which shortens the response time by narrowing the cell gap to 2-3 μm to enlarge the field intensity, and a vertical orientation mode in which the liquid crystal is, since the orientation restraining force of an orientation film is week in that mode, expected to respond at the higher speed than in the case of the TN mode. However, it is difficult to realize a response time on the order of microsecond with the nematic liquid crystal.

Spontaneous polarization liquid crystal is a material to replace the nematic liquid crystal, and can respond at high speed on the order of microsecond since the interaction between spontaneous polarization and the electric field performs switching. For example, tristable antiferroelectric liquid crystal and bistable ferroelectric liquid crystal are used in a simple matrix panel. FIG. 7A illustrates the relationship between the applied voltage and the transmittance in case of tristable antiferroelectric liquid crystal, while FIG. 7B illustrates the relationship between the applied voltage and the transmittance in case of bistable ferroelectric liquid crystal. As can be seen, two levels, i.e., a white level and a black level are stable in case of tristable antiferroelectric liquid crystal and bistable ferroelectric liquid crystal. In order to perform halftone display, area gradation for displaying gray scale by adjusting the number of white pixels and the number of black pixels, time gradation for displaying gradation by adjusting the display time, or the like is used. In case the liquid crystal is used in a panel, the response of the liquid crystal is typically between the white level and the black level.

In a simple matrix panel (FIG. 8), scanning lines (X1, X2, . . . , Xn) 801 and signal lines (Y1, Y2, . . . , Yn) 802 are arranged like a matrix. When tristable antiferroelectric liquid crystal and bistable ferroelectric liquid crystal are used in a simple matrix panel, it is preferable that the hysteresis width is large. Hysteresis is the difference in transmittance due to the course of voltage. Hysteresis width 701 is defined as the difference between voltages presenting the same transmittance. For example, to drive tristable antiferroelectric liquid crystal in a simple matrix panel, it is appropriate to perform bias driving. Here, since the bias voltage is always applied, i.e., applied even when the liquid crystal panel displays the black level, in order to realize a satisfactory black level, it is desirable to use liquid crystal having clear threshold characteristics with a region where the transmittance does not change even when the bias voltage is applied thereto.

As spontaneous polarization liquid crystal capable of analog gradation, liquid crystal referred to as thresholdless liquid crystal or V-shaped liquid crystal is attracting attention (Japanese Patent Application Laid-open Nos. Hei 9-50050 and Hei 10-301091 applied by CASIO COMPUTER CO., LTD). Though thresholdless liquid crystal presents a chiral smectic $C_A$ phase in a bulk state, when it is encapsulated between substrates, differently from its ordinary state, it is orientated with a tilt with respect to the substrate main surface, and the tilt continuously changes according to the applied electric field. Since the liquid crystal presents a mixed phase over its whole thickness, the directors move smoothly with no clear threshold, which makes the hysteresis unliable to occur. This makes it possible to perform gradation display, which is impossible when tristable antiferroelectric liquid crystal and bistable ferroelectric liquid crystal are used. In addition, because of the spontaneous polarization, the interaction between the spontaneous polarization and the electric field performs switching at high speed. Domainless switching, which is impossible when tristable antiferroelectric liquid crystal and bistable ferroelectric liquid crystal are used, makes it possible to decrease domain and achieve display with a high contrast even in halftone display.

Further, thresholdless liquid crystal is said to have a $SmC_R$* phase without a correlation of liquid crystal molecule tilt between layers (a chiral smectic $C_R$ phase) when no electric field is applied thereto. Since, when no voltage is applied, the directors of the liquid crystal are oriented at arbitrary tilt angles of cones and the tilt angle is different between the layers, the spontaneous polarization of the liquid crystal is canceled out to be zero as a whole. The average optical axis of the liquid crystal is identical with the axis of the cones (Japanese Patent Application Laid-open No. Hei 10-082985).

The hysteresis of thresholdless liquid crystal is smaller than that of the tristable antiferroelectric liquid crystal and bistable ferroelectric liquid crystal illustrated in FIGS. 7A and 7B. Since thresholdless liquid crystal has no clear threshold characteristics and the brightness increases monotonically according to the applied voltage, it is generally used in an active matrix panel. In driving where the bias voltage is always applied to a liquid crystal panel such as bias driving in a passive matrix panel, the liquid crystal is switched by the bias voltage to lower the black level.

SUMMARY OF THE INVENTION

The present invention has been made in view of the above, and firstly, an object of the present invention is to, by improving the driving method, further lower the hysteresis observed to some extent in thresholdless liquid crystal material, V-shaped liquid crystal material, or liquid crystal material having a chiral smectic $C_R$ phase to perform satisfactory gradation display.

The present invention can be equally applied to thresholdless liquid crystal material, V-shaped liquid crystal material, and liquid crystal material having a chiral smectic $C_R$ phase. However, for the sake of simplicity, these kinds of liquid crystal are collectively referred to as thresholdless liquid crystal in the following description.

Each drawing of FIGS. 9A to 9D shows a relationship between a cell voltage (described later) and a transmittance. As illustrated in FIGS. 9A to 9D, depending on the conditions of the liquid crystal cell of thresholdless liquid crystal, hysteresis is observed to some extent. FIGS. 9A to 9D indicate the characteristics of hysteresis of the thresholdless liquid crystal. In FIGS. 9A and 9B is shown the variety of the orientation film thickness. FIG. 9A is in a case that the orientation film is thin while FIG. 9B, thick. In FIGS. 9C and 9D is shown the variety of the spontaneous polarization. FIG. 9C is in a case that the spontaneous polarization is small while FIG. 9D, large. In particular, when the orientation film thickness is thin (*Fukuda*, Liquid Crystals, Vol. 25, LCT100975, 1998) and when the spontaneous polarization of the liquid crystal is small, the hysteresis is liable to occur. The present invention is effective for such liquid crystal having a small spontaneous polarization and such cell having a thin orientation film thickness.

Secondly, another object of the present invention is to, by improving the driving method, shorten the response time of thresholdless liquid crystal. In particular, the present invention is effective for thresholdless liquid crystal having the spontaneous polarization of 40 $nC/cm^2$, which is relatively small as the spontaneous polarization of thresholdless liquid crystal.

Thirdly, another object of the present invention is to provide a driving method that can secure a sufficient white level and that can prevent hysteresis in case, for example, the driving voltage is limited by the withstand voltage of active elements in active matrix driving. It is to be noted that, as used herein, the term "withstand voltage" means that a voltage which the active elements can apply to the liquid crystal has an upper limit. More specifically, the present invention is effective in greatly decreasing the hysteresis with the orientation film thickness being thin to prevent voltage loss due to the orientation film for the purpose of obtaining a sufficient white level. In addition, the present invention is effective in greatly decreasing the hysteresis in a liquid crystal cell with a small spontaneous polarization for the purpose of preventing lowered potential of an auxiliary capacitor accompanying reversal of the spontaneous polarization.

An active element includes a thin film transistor, a diode (two-terminal element), an MIM (Metal-Insulator-Metal) element, and the like. Here, a case where the active element is a thin film transistor is described. As illustrated in FIG. 10, a thin film transistor 1003 as a switching element for driving liquid crystal is disposed at each intersection of scanning lines 1002 and signal lines 1001 arranged like a matrix. According to the signal voltage determined by the signal line, charge is supplied to an auxiliary capacitor with a liquid crystal layer 1004 being as a dielectric and to an auxiliary capacitor 1005 connected in parallel with the liquid crystal layer. As used herein, the term "external voltage" corresponds to a signal voltage in a thin film transistor, and is a voltage applied to the liquid crystal layer 1004 and the auxiliary capacitor 1005 during a period where the scanning line 1001 is selected. The term "cell voltage" means a voltage applied to the liquid crystal layer 1004, i.e., a voltage applied to the orientation film and the liquid crystal. The term "liquid crystal effective voltage" means a voltage applied only to the liquid crystal. Since the cell voltage is lower than the external voltage due to the reversal of spontaneous polarization of thresholdless liquid crystal, and since the liquid crystal effective voltage is lower than the cell voltage due to the voltage loss of the orientation film, the external voltage is higher than the cell voltage, which is in turn higher than the liquid crystal effective voltage.

As illustrated in FIGS. 9A and 9B, the hysteresis of thresholdless liquid crystal tends to become smaller as the orientation film thickness becomes thicker. However, it is not appropriate that the orientation film thickness is blindly made thicker to suppress the hysteresis. Since the orientation film and the spontaneous polarization liquid crystal having a high permittivity are serially connected, if the orientation film is thick and the voltage loss is large, the liquid crystal effective voltage applied to the liquid crystal is low, and thus, the liquid crystal can not be reversed sufficiently and the white level can not be sufficient. There is an approach to, by increasing the external voltage to ±10-±20 V, increase the liquid crystal effective voltage applied to the liquid crystal, but, with regard to a thin film transistor where the external voltage is as low as ±5-±7 V, the external voltage can be increased only to a limited extent. Therefore, to improve the white level in active matrix driving where the external voltage is limited, it is desirable that the effective voltage applied to the liquid crystal is increased by making the orientation film thinner. However, in active matrix driving, if optimization is carried out to make the white level sufficient, though it depends on the spontaneous polarization of the liquid crystal, the most appropriate orientation film thickness becomes thin, which makes the hysteresis more liable to occur.

More specifically, in active matrix driving of thresholdless liquid crystal, if the orientation film thickness is made thicker, the hysteresis is suppressed more, but, a sufficient white level can not be obtained unless the orientation film thickness is made thinner. This relationship is a trade-off.

As illustrated in FIGS. 9C and 9D, the hysteresis of thresholdless liquid crystal tends to become smaller as the spontaneous polarization becomes larger. However, it is not appropriate that the spontaneous polarization is blindly made larger. Since a thin film transistor is driven by constant charge, if the spontaneous polarization is too large, charge sufficient to reverse the spontaneous polarization of the thresholdless liquid crystal can not be supplied, which deteriorates the white level.

When the external voltage is applied, charge stored in the liquid crystal cell and the auxiliary capacitor decreases as the spontaneous polarization is reversed, and the cell voltage after the spontaneous polarization is reversed is greatly lowered compared with the initially applied external voltage. Of course, the lowered cell voltage lowers the liquid crystal effective voltage and the white level. If the driving voltage can be increased, a sufficient white level can be secured after the spontaneous polarization is reversed even with a limited auxiliary capacitor. However, in active matrix driving, the driving voltage is limited by the withstand voltage of the active elements.

In this way, in driving using thin film transistors with the external voltage of the active elements having an upper limit, to make the white level satisfactory, it is often the case that, the orientation film thickness is made thinner in order to prevent the voltage loss due to the orientation film, or, the spontaneous polarization of the liquid crystal is made smaller in order to prevent the potential of the auxiliary capacitor from being lowered. However, when the spontaneous polarization is small and the orientation film thickness is thin, the hysteresis is inevitably liable to occur.

More specifically, in active matrix driving of thresholdless liquid crystal, if the spontaneous polarization is made larger, the white level is deteriorated, and, if the spontaneous polarization is made smaller, the hysteresis is made larger. This relationship is a trade-off. However, according to a driving method of the present invention, the hysteresis can be made smaller even when such thresholdless liquid crystal with a small spontaneous polarization is used.

Fourthly, with a conventionally disclosed driving method for decreasing the hysteresis, the black level is deteriorated. According to the present invention, more satisfactory black display can be performed compared with the case of a conventional driving method. A conventional driving method is illustrated in FIG. 1, where a reset pulse $V_L$ for preventing burn-in, a set pulse $V_H$, and a gradation display pulse $V_D$ are applied during a scanning line selection period 101 (Japanese Patent Application Laid-open Nos. Hei 10-073803 and Hei 10-082985, both applied by CASIO COMPUTER CO., LTD). More specifically, by making the liquid crystal in a uniformly oriented state using the set pulse $V_H$ and then performing the switching, the hysteresis is decreased. However, in this case, even when black display 102 is desired, a white level 104 by a set pulse $V_{H2}$ 103 is recognized by the user, and thus, the black level is deteriorated.

Fifthly, another object of the present invention is to perform satisfactory gradation display when thresholdless liquid crystal is driven with an auxiliary capacitor serially connected to an active element such as a thin film transistor. More specifically, suppose that the voltage of +5 V or +1 V is applied to the liquid crystal layer in a first frame, and the voltage of −3 V is applied to the liquid crystal layer in a second frame by alternate current driving. However, depending on the voltage applied to the liquid crystal layer in the first frame, the brightness differs in the second frame after the spontaneous polarization of the liquid crystal is reversed. More specifically, the second frame is in a darker gradation when the first frame is +5 V compared with the case where the first frame is +1 V. When thresholdless liquid crystal is driven, gradation differs depending on the voltage in the preceding frame.

Means for solving the problems is described in the following.

It is to be noted that a period during which the voltage of 0 V is applied to the liquid crystal layer is herein referred to as a reset period, a "0 V" reset period, or a first period. Voltage applied to the liquid crystal during the reset period is referred to as reset voltage. When the liquid crystal is oriented by reset voltage being applied thereto, it is expressed that the liquid crystal is in a reset position. Further, a period, during which a voltage corresponding to the display gradation is applied to the liquid crystal layer, is referred to as a gradation display period or a second period.

According to the present invention, in thresholdless liquid crystal, by providing the first period as the reset period at the potential of 0 V before the second period for performing gradation display and by driving the thresholdless liquid crystal from a predetermined position, hysteresis of the liquid crystal is prevented. By applying the present invention, satisfactory gradation display can be performed even when the orientation film is thin and thus the hysteresis is liable to occur and even when the spontaneous polarization is small and thus the hysteresis is liable to occur.

The first period as the reset period at the potential of 0 V may be provided either before or after the second period for performing gradation display. By alternately providing the first periods and the second periods, as a result, the thresholdless liquid crystal is returned to a reference position in the first periods and is driven thereafter.

Further, according to the present invention, when thresholdless liquid crystal is driven by serially connecting an auxiliary capacitor to an active element, for example, a thin film transistor, the first period as the "0 V" reset period is provided either before or after the second period for performing gradation display. Charge stored in a capacitor with a liquid crystal layer being as dielectric and in an auxiliary capacitor which is connected in series with an active element is discharged in the first period. Then, in the second period, charge is supplied to the auxiliary capacitor and to the capacitor with the liquid crystal layer being as dielectric to switch the thresholdless liquid crystal. By this, irrespective of the amount of charge stored in the preceding frame in the capacitor with the liquid crystal layer being as dielectric and in the auxiliary capacitor, the thresholdless liquid crystal is switched in the second period to a unique position corresponding to the supplied charge.

Further, according to the present invention, by providing the first period as the "0 V" reset period, even when time necessary for switching between halftones of different polarities in thresholdless liquid crystal is considerably long, since the liquid crystal is switched via the "0 V" reset period, i.e., the first period, the response time of the liquid crystal can be shortened. In other words, the present invention is effective in improving the response time when time necessary for switching between halftones in thresholdless liquid crystal is considerably longer than that via "0 V". In particular, there is a tendency that the switching speed between halftones is deteriorated when the spontaneous polarization of the liquid crystal is 40 $nC/cm^2$ or less, and thus, the present invention is particularly effective in driving a liquid crystal display device using thresholdless liquid crystal having the spontaneous polarization of 40 $nC/cm^2$ or less.

Further, according to the present invention, the orientation of the liquid crystal during the "0 V" reset period, i.e., the first period, is for the black display. When black is displayed in gradation display, since the reset period displays black, no color mixing due to the reset period is caused. In addition, when the liquid crystal is oriented during the reset period, i.e., the first period, the spontaneous polarization is canceled out, and therefore, no burn-in of the liquid crystal due to the reset period is caused.

According to the present invention, a method of driving a liquid crystal display device is provided, the liquid crystal display device comprising a pair of substrates, an orientation film formed on one of the substrates and having a function to orient liquid crystal, and the liquid crystal having a chiral smectic $C_R$ phase and being continuously switched according to electric field applied thereto, characterized in that at least one subframe period is a reset period, i.e., a first period where a voltage applied to the liquid crystal is 0V, a plurality of subframe periods forming one frame for displaying one image signal, and in that a gradation display period or a second period for applying a pulse having a voltage corresponding to predetermined gradation display is provided before or after the reset period.

The present invention is particularly effective when at least one of the pair of substrates has active elements for applying voltage to a liquid crystal layer and voltage to be applied is limited by the withstand voltage of the active elements. More specifically, when, with the driving voltage being limited, optimization is to be performed to display a sufficient white level, it is necessary that either the orientation film thickness is made thinner in order to prevent the voltage loss, or, the spontaneous polarization of the thresholdless liquid crystal is made smaller in order to suppress drop in the potential of the auxiliary capacitor, which follows that, as illustrated in FIGS. 9A to 9D, the hysteresis of the thresholdless liquid crystal is more liable to occur. However, by applying the present invention, the hysteresis can be decreased. Therefore, the present invention is particularly effective when the driving voltage is low, for example, when the withstand voltage of the active elements is ±7 V or lower. Further, when the spontaneous polarization of the liquid crystal is 40-150 nC/cm$^2$ and the orientation film thickness after post-bake is 15-75 nm, or, when the spontaneous polarization of the liquid crystal is 20-40 nC/cm$^2$ and the orientation film thickness after post-bake is 30-150 nm, the spontaneous polarization is small and the orientation film thickness is thin, and therefore, the hysteresis is liable to occur. The present invention is particularly effective for such a liquid crystal display device where the hysteresis is liable to occur.

According to the present invention, by switching thresholdless liquid crystal from a reference position, i.e., the voltage of 0 V, the hysteresis of the thresholdless liquid crystal is decreased.

Firstly, by introducing the "0 V" reset period, the hysteresis is made less liable to occur even when the spontaneous polarization material and the orientation film thickness are such that the hysteresis is liable to occur, and satisfactory gradation display can be performed. Since the hysteresis of thresholdless liquid crystal is more liable to occur when the thresholdless liquid crystal has a smaller spontaneous polarization, the present invention is more effective for a material having a small spontaneous polarization (40 nC/cm$^2$ or less). Further, since the hysteresis of thresholdless liquid crystal is more liable to occur when the thresholdless liquid crystal has a thinner orientation film thickness, the present invention is more effective for a panel having a thin orientation film thickness.

Secondly, by providing the "0 V" reset period, improvement in the response time can be observed. This is particularly remarkable with regard to liquid crystal having a small spontaneous polarization of 40 nC/cm$^2$ or less. Further, the present invention is particularly effective when time necessary for switching between halftones in liquid crystal is longer than that via "0 V".

Thirdly, in active matrix driving with the driving voltage being limited, when the orientation film thickness is made thinner in order to prevent the voltage loss due to the orientation film, or, when the spontaneous polarization of the thresholdless liquid crystal is made smaller in order to prevent voltage drop due to the lowered potential of the auxiliary capacitor, the hysteresis is inevitably liable to occur. However, by introducing the "0 V" reset period, the hysteresis is suppressed, and satisfactory gradation display can be performed. The conditions of cells used in the active matrix driving are, with regard to a thin film transistor, for example, the spontaneous polarization of 40-150 nC/cm$^2$ and the orientation film thickness of 15-75 nm, or, the spontaneous polarization of 20-40 nC/cm$^2$ and the orientation film thickness of 75-150 nm. The present invention is particularly effective on these conditions.

Fourthly, compared with conventional driving that aims to decrease the hysteresis in thresholdless liquid crystal, according to the present invention, since the voltage during the reset period is "0 V", the spontaneous polarization of the liquid crystal is canceled out on the average, and burn-in due to the reset period can be suppressed. In addition, since the display during the reset period is for the black level, when black is displayed in gradation display, no color mixing, due to display during the reset period, is caused, and stable black can be displayed. Further, it has been found that there is an effect of decreasing the hysteresis compared with conventional driving.

Fifthly, the present invention is characterized by providing the "0 V" reset period to prevent a shift in the voltage-transmittance characteristics. More specifically, as described in the following Comparative Example 1, when the reset voltage is +1 V, the voltage-transmittance characteristics tend to shift to the positive voltage side. When the voltage-transmittance characteristics shift to the positive voltage side, the voltage inclines to the positive polarity, leading to burn-in. It is desirable that the reset voltage is made to be "0 V" to prevent such shift in the voltage-transmittance characteristics as much as possible.

Sixthly, according to the present invention, substantially returning the liquid crystal to a reset position during the "0 V" reset period has an effect of decreasing the hysteresis. It is thus also within the scope of the present invention to modify the driving method as in the following, considering that to substantially return the liquid crystal to the reset position during the "0 V" reset period is essential.

The "0 V" reset period can be freely set according to the response time of the liquid crystal. Since what is necessary is to make a response time ($T_3$) during which the liquid crystal is reset to "0 V" shorter than a reset period ($T_1$), ($T_3<T_1$), it is possible to make longer the period of bright display by making the reset period ($T_1$) shorter than a gradation display period ($T_2$), ($T_1<T_2$).

Since the present invention is effective when the liquid crystal substantially returns to the reset position during the "0 V" reset period, it is desirable that the response time of the liquid crystal is comparatively short in the range of the driving voltage. It is also possible to shorten the response time of the liquid crystal returning to the "0 V" reset position by lowering the viscosity of the liquid crystal in a panel with high environmental temperature such as a projector panel. Further, it is also possible to provide voltage pulses having opposite polarities in one frame period to prevent burn-in.

Seventhly, according to the present invention, by providing the "0 V" reset period, when liquid crystal is driven with a thin film transistor provided with an auxiliary capacitor, charge stored in the liquid crystal layer and in the auxiliary capacitor that depends on the gradation in the preceding frame can be canceled out by the "0 V" reset period. Therefore, irrespective of the voltage in the preceding frame, satisfactory gradation display can be performed.

According to the present invention, a first object of the present invention is characterized in that, in a method of driving a liquid crystal display device, the liquid crystal display device includes an orientation film over a substrate, and a liquid crystal material over orientation film, wherein the liquid crystal material has a chiral smectic $C_R$ phase and is continuously switched according to an electric field applied thereto, and the driving method comprises the steps of displaying a black level by the liquid crystal material in a first period, applying a voltage to the liquid crystal material for a gradation display in a second period, wherein the second period comes before or after the first period.

In the method of driving the liquid crystal display device, a plurality of active elements are formed over the substrate.

In the method of driving the liquid crystal display device, each of the plurality of active elements applies a voltage to the liquid crystal material, and the voltage has an upper limit.

In the method of driving the liquid crystal display device, the upper limit of the voltage has an absolute value of 7 V or less.

In the method of driving the liquid crystal display device, a spontaneous polarization of the liquid crystal material is 40 $nC/cm^2$-150 $nC/cm^2$, and a thickness of the orientation film is 15 nm-75 nm.

In the method of driving the liquid crystal display device, a spontaneous polarization of the liquid crystal material is 20 $nC/cm^2$-40 $nC/cm^2$, and a thickness of the orientation film is 30 nm-150 nm.

In the method of driving the liquid crystal display device, a spontaneous polarization of the liquid crystal material is 40 $nC/cm^2$ or less.

In the method of driving the liquid crystal display device, when a first response time is defined as a response time of the liquid crystal material between a first voltage and a second voltage having an opposite polarity to the first voltage not via a voltage of 0V, and when a second response time is defined as a response time of the liquid crystal material between a first voltage and a second voltage having an opposite polarity to the first voltage via the voltage of 0V, the second response time is five times or more as short as the first response time.

In the method of driving the liquid crystal display device, each of the plurality of active elements is connected in series to an auxiliary capacitor.

In the method of driving the liquid crystal display device, a spontaneous polarization of the liquid crystal is 100 $nC/cm^2$ or less, and the thickness of the orientation film is 75 nm or less.

A second object of the present invention is characterized in that, in a method of driving a liquid crystal display device, the liquid crystal display device includes an orientation film over a substrate, and a liquid crystal material over the orientation film, wherein liquid crystal material has a chiral smectic $C_R$ phase and is continuously switched according to an electric field applied thereto, and the driving method comprises the steps of canceling out a spontaneous polarization of the liquid crystal material in a first period, and applying a voltage to the liquid crystal material for a gradation display in a second period, wherein the second period comes before or after the first period.

In the method of driving the liquid crystal display device, a plurality of active elements are formed over the substrate.

In the method of driving the liquid crystal display device, each of the plurality of active elements applies a voltage to the liquid crystal material, and the voltage has an upper limit.

In the method of driving the liquid crystal display device, the upper limit of the voltage has an absolute value of 7 V or less.

In the method of driving the liquid crystal display device, the spontaneous polarization of the liquid crystal material is 40 $nC/cm^2$-150 $nC/cm^2$, and a thickness of the orientation film is 15 nm-75 nm.

In the method of driving the liquid crystal display device, the spontaneous polarization of the liquid crystal material is 20 $nC/cm^2$-40 $nC/cm^2$, and a thickness of the orientation film is 30 nm-150 nm.

In the method of driving the liquid crystal display device, the spontaneous polarization of the liquid crystal material is 40 $nC/cm^2$ or less.

In the method of driving the liquid crystal display device, when a first response time is defined as a response time of the liquid crystal material between a first voltage and a second voltage having an opposite polarity to the first voltage not via a voltage of 0V, and when a second response time is defined as a response time of the liquid crystal material between a first voltage and a second voltage having an opposite polarity to the first voltage via the voltage of 0V, the second response time is five times or more as short as the first response time.

In the method of driving the liquid crystal display device, each of the plurality of active elements is connected in series to an auxiliary capacitor.

In the method of driving the liquid crystal display device, the spontaneous polarization of the liquid crystal is 100 $nC/cm^2$ or less, and the thickness of the orientation film is 75 nm or less.

A third object of the present invention is characterized in that, in a method of driving a liquid crystal display device, the liquid crystal display device includes an orientation film over a substrate, and a liquid crystal material over the orientation film, wherein the liquid crystal material has a chiral smectic $C_R$ phase and is continuously switched according to an electric field applied thereto, and the driving method comprising the steps of applying a voltage of 0V to the liquid crystal material, and applying a voltage to the liquid crystal material for a gradation display in a second period, wherein the second period comes before or after the first period.

In the method of driving the liquid crystal display device, a plurality of active elements are formed over the substrate.

In the method of driving the liquid crystal display device, each of the plurality of active elements applies a voltage to the liquid crystal material, and the voltage has an upper limit.

In the method of driving the liquid crystal display device, the upper limit of the voltage has an absolute value of 7 V or less.

In the method of driving the liquid crystal display device, a spontaneous polarization of the liquid crystal material is 40 $nC/cm^2$-150 $nC/cm^2$, and a thickness of the orientation film is 15 nm-75 nm.

In the method of driving the liquid crystal display device, a spontaneous polarization of the liquid crystal material is 20 $nC/cm^2$-40 $nC/cm^2$, and a thickness of the orientation film is 30 nm-150 nm.

In the method of driving the liquid crystal display device, a spontaneous polarization of the liquid crystal material is 40 $nC/cm^2$ or less.

In the method of driving the liquid crystal display device, when a first response time is defined as a response time of the liquid crystal material between a first voltage and a second voltage having an opposite polarity to the first voltage not via the voltage of 0V, and when a second response time is defined as a response time of the liquid crystal material between a first voltage and a second voltage having an opposite polarity to the first voltage via the voltage of 0V, the second response time is five times or more as short as the first response time.

In the method of driving the liquid crystal display device, each of the plurality of active elements is connected in series to an auxiliary capacitor.

In the method of driving the liquid crystal display device, a spontaneous polarization of the liquid crystal is 100 $nC/cm^2$ or less, and the thickness of the orientation film is 75 nm or less.

A fourth object of the present invention is characterized in that, in a method of driving a liquid crystal display device, the liquid crystal display device includes a plurality of thin film transistors being provided over a substrate, an auxiliary capacitor being connected in series to each of the plurality of thin film transistors, an orientation film over each of the plurality of thin film transistors; and a liquid crystal material over the orientation film, wherein the liquid crystal material has a spontaneous polarization and is continuously switched according to an electric field applied thereto, and the driving method comprises the steps of applying a voltage of 0V to the liquid crystal material in a first period, and performing a gradation display in a second period, wherein the second period comes before or after the first period.

In the method of driving the liquid crystal display device, a transmittance of the liquid crystal material is uniquely determined when voltages having a same absolute value and opposite polarities are applied thereto.

In the method of driving the liquid crystal display device, the liquid crystal material has a same tilt angle when voltages having a same absolute value and opposite polarities are applied thereto.

In the method of driving the liquid crystal display device, the liquid crystal material has a chiral smectic $C_R$ phase.

DETAILED DESCRIPTION OF THE PREFERRED EMBODIMENTS

Embodiment Mode 1

In Embodiment Mode 1, by applying the present invention to thresholdless liquid crystal material having a relatively large spontaneous polarization, the hysteresis was decreased and satisfactory gradation display was performed. With regard to the response time of the liquid crystal material, since the spontaneous polarization was as large as 100 $nC/cm^2$, no remarkable difference was observed between a case where a "0 V" reset period was provided and a case where a "0 V" reset period was not provided.

Figure 6A:
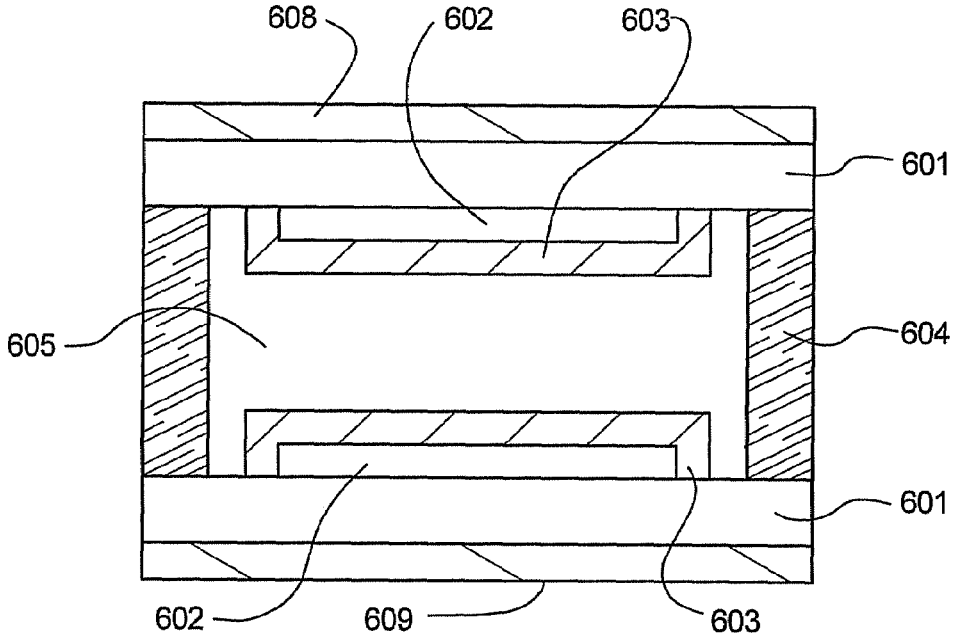
FIGS. 6A and 6B illustrate a liquid crystal cell used in an example of the present invention.
Figure 6B:
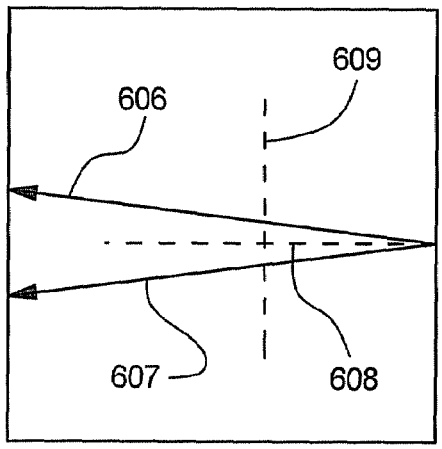
Figure 7A:
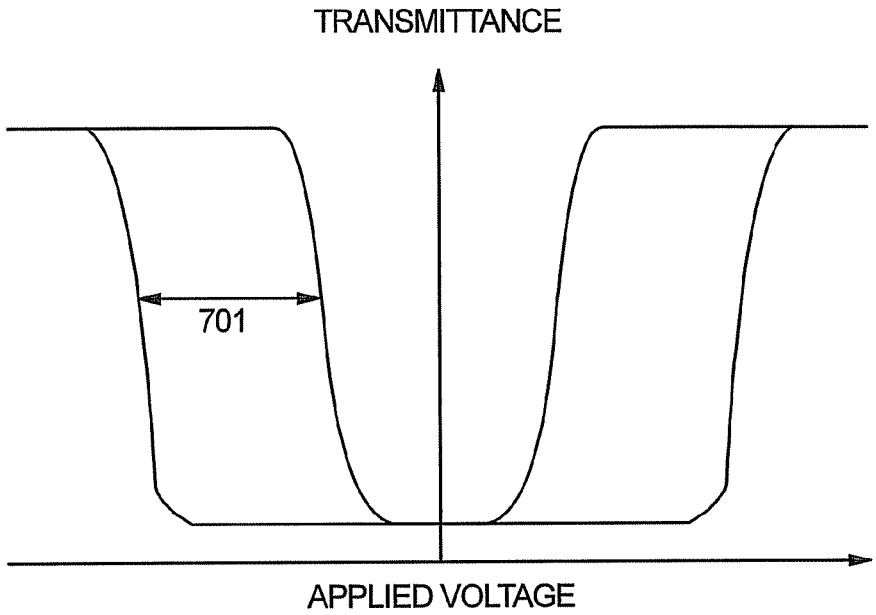
FIG. 7A PRIOR ART
FIGS. 7A and 7B illustrate conventional hysteresis curves of tristable antiferroelectric liquid crystal and bistable ferroelectric liquid crystal.
Figure 7B:
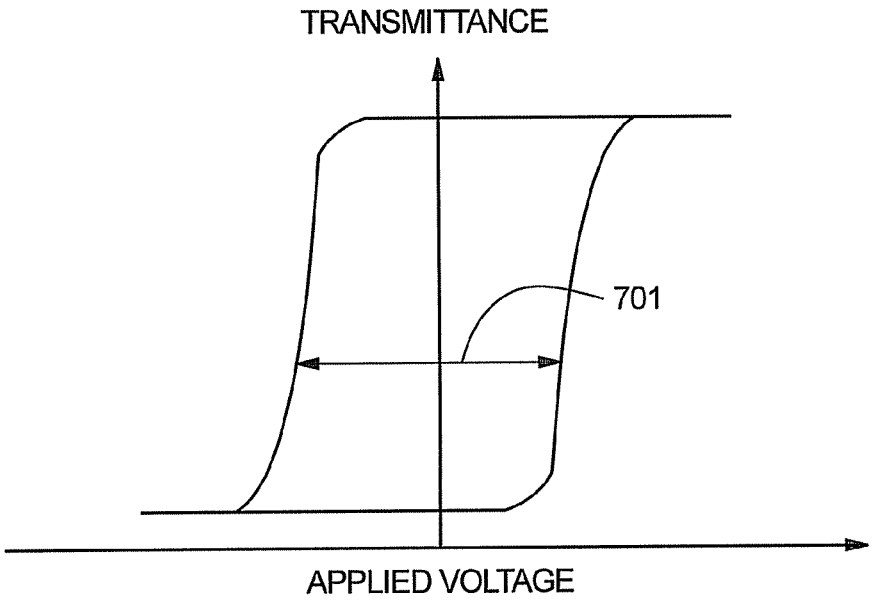
FIG. 7B PRIOR ART
Figure 8:
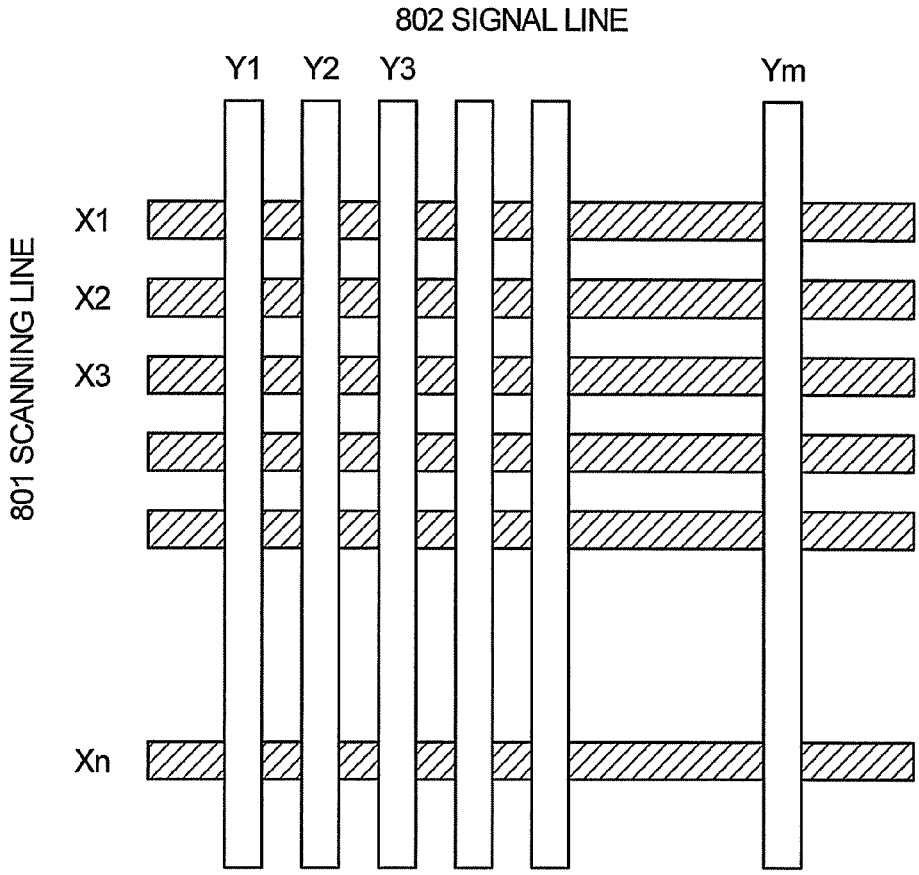
FIG. 8 PRIOR ART
FIG. 8 illustrates the structure of a conventional passive matrix panel.
Figure 9A:
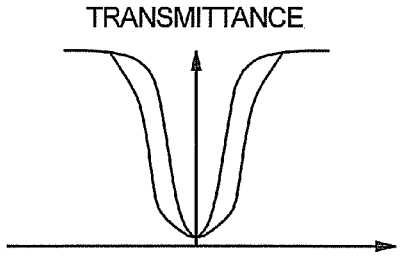
FIGS. 9A to 9D illustrate characteristics of the hysteresis of thresholdless liquid crystal of the present invention.
Figure 9B:
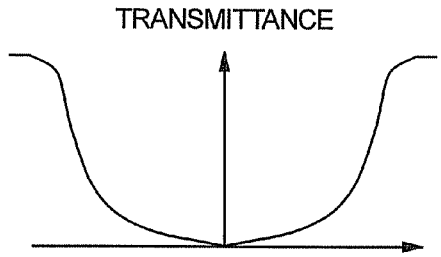
Figure 9C:
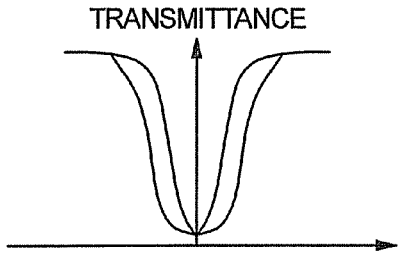
Figure 9D:
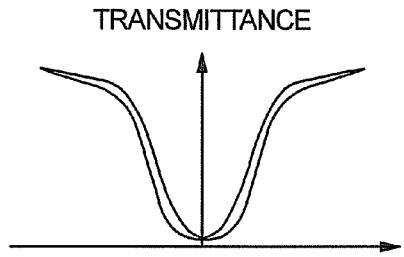
Figure 10:
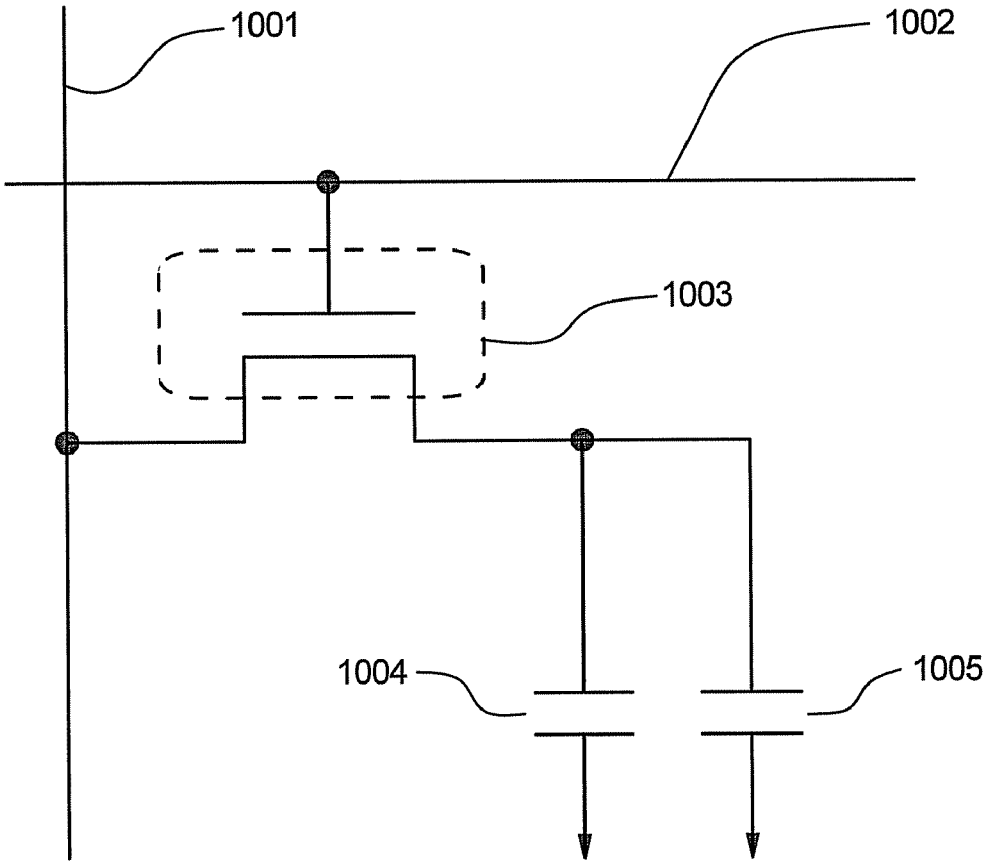
FIG. 10 illustrates a circuit in an active matrix panel using a thin film transistor as an example of a panel where thresholdless liquid crystal is driven of the present invention.

FIGS. 6A and 6B are a sectional view and a top view of a liquid crystal cell, respectively. ITO (indium tin oxide) 602 is patterned over a quartz substrate 601 at the film thickness of 120 nm. A low-pretilted orientation film 603 is formed on the ITO by printing, pre-baking, and post-baking the orientation film. The orientation film is treated to be rubbed. An anilox roller of an orientation film printing apparatus has minute grooves formed therein. The finer the grooves are, the thinner the orientation film thickness to be printed becomes. In Embodiment Mode 1, in order to make satisfactory the white level in driving using an active element having an upper limit with regard to a voltage applicable to a liquid crystal layer, for example, a thin film transistor, the orientation film thickness is as thin as 60 nm. In order to make the orientation film thickness after post-bake to be 60 nm, an anilox roller having the line number of about 250-360 lines/inch is used in the orientation film printing apparatus. Since the axis of orientation of thresholdless liquid crystal tends to tilt from a rubbing axis by about 0-15°, rubbing axes 606 and 607 are crossed when a pair of substrates 601 are affixed to each other to fix the optical axis of the liquid crystal. In order to prevent orientation defects, no spacer is scattered. Sealing material 604 is provided at end portions of the liquid crystal cell with a space being formed between the two substrates. The cell gap of the liquid crystal cell is 2.0 μm. Polarizing plates 608 and 609 are affixed to the substrates, respectively. When no voltage is applied to the liquid crystal cell, in the wavelength range of visible radiation, the transmission axis of the polarizing plate 608 which is set to be crossed Nicol and the optical axis of the liquid crystal can be approximated to be substantially parallel with each other, and thus, the liquid crystal cell displays black. Further, when no voltage is applied, since cones of the liquid crystal are oriented randomly, the spontaneous polarization of the liquid crystal is canceled out as a whole.

Figure 3A:
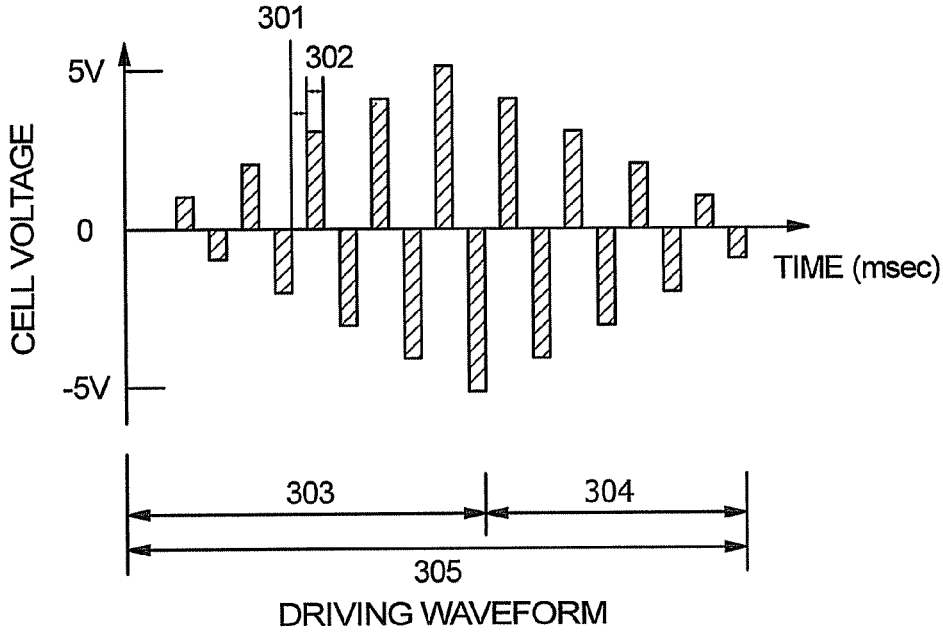
FIGS. 3A and 3B illustrate a driving waveform and the driving result when the "0 V" reset period is provided of the present invention.
Figure 3B:
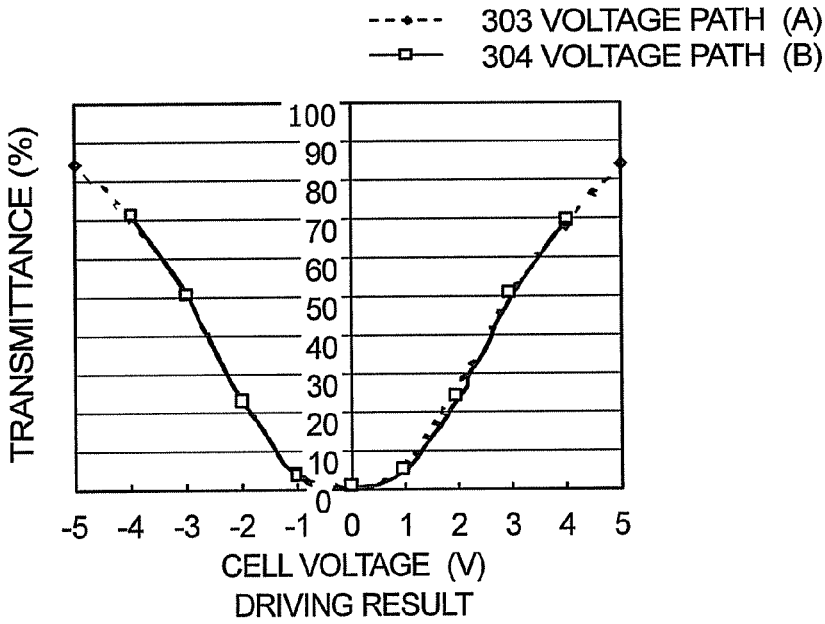

A driving waveform was formed using a function generator Model No. "MODEL275" manufactured by Waveteck Co. Ltd. Though a thin film transistor that actually drives thresholdless liquid crystal is driven by a constant charge, characteristics of such a thin film transistor was provisionally examined when the thin film transistor was driven by a constant current. Since the thin film transistor is driven by a constant current, charge according to reversal of spontaneous polarization of the liquid crystal is supplied during a period where a voltage is applied to the liquid crystal layer, i.e., during a pulse period. FIGS. 3A and 3B indicate the driving waveform and the driving result when the "0V" reset period is provided. FIG. 3A illustrates a driving waveform used in driving the liquid crystal cell. In FIG. 3A, the horizontal axis is time while the vertical axis is the cell voltage. Before a gradation display period by a gradation display pulse 302 (second period), there is a first period 301 as a "0 V" reset period. In the experiment, pulse widths 301 and 302 were both 8.3 msec. A voltage path (A) 303 starts with 0 V, and goes through +1 V, −1 V, +2 V, −2 V, +3 V, −3 V, +4 V, −4 V, and +5 V to reach −5 V. The polarity of voltage alternates between positive and negative, and the absolute value of the cell voltage applied to the liquid crystal cell is sequentially increased by 1 V. A voltage path (B) 304 starts with +4 V, and goes through −4 V, +3 V, −3 V, +2 V, −2 V, +1 V, and −1 V to reach 0 V. The polarity of voltage alternates between positive and negative, and the absolute value of the cell voltage applied to the liquid crystal cell is sequentially decreased by 1 V. The waveform where the voltage paths (A) and (B) formed one cycle 305 was continuously inputted to the liquid crystal cell.

The relationship between the voltage of the pulse used for driving the liquid crystal cell and the quantity of light of the liquid crystal cell is illustrated in the graph of FIG. 3B. Transmittance is plotted with regard to each cell voltage. Since the optical response of the liquid crystal changed over time during application of the pulse to the liquid crystal cell, the final brightness reached was used as the transmittance. In the graph, a voltage applied to the liquid crystal and the orientation film was used as the cell voltage.

When the spontaneous polarization of thresholdless liquid crystal is made smaller and the orientation film thickness is made thinner to make sufficient the white level with the driving voltage of an ordinary active matrix panel, for example, the driving voltage of a thin film transistor (±5-±7 V), it is desirable that the thresholdless liquid crystal has the spontaneous polarization of 40-150 nC/cm$^2$ and the orientation film thickness after the post-bake is as thin as 15-75 nm, with the voltage loss being suppressed and the liquid crystal effective voltage being high. With regard to thresholdless liquid crystal having the spontaneous polarization of 20-40 nC/cm$^2$, it is thought to be desirable that the orientation film thickness is 75-150 nm. However, with these combinations of the spontaneous polarization and the orientation film thickness of thresholdless liquid crystal, since the orientation film thickness is thin and the spontaneous polarization is small, the hysteresis is liable to occur.

The orientation film thickness according to Embodiment Mode 1 is optimized for driving using an active element having an upper limit with regard to a voltage applicable to the liquid crystal and the orientation film, for example, a thin film transistor, and thus, the orientation film thickness is as thin as 60 nm, with which the hysteresis is liable to occur. However, since the first period as the "0 V" reset period is provided and the liquid crystal is switched from the reset position, satisfactory gradation display can be performed with almost no difference in brightness between the voltage paths (A) and (B).

Figure 17A:
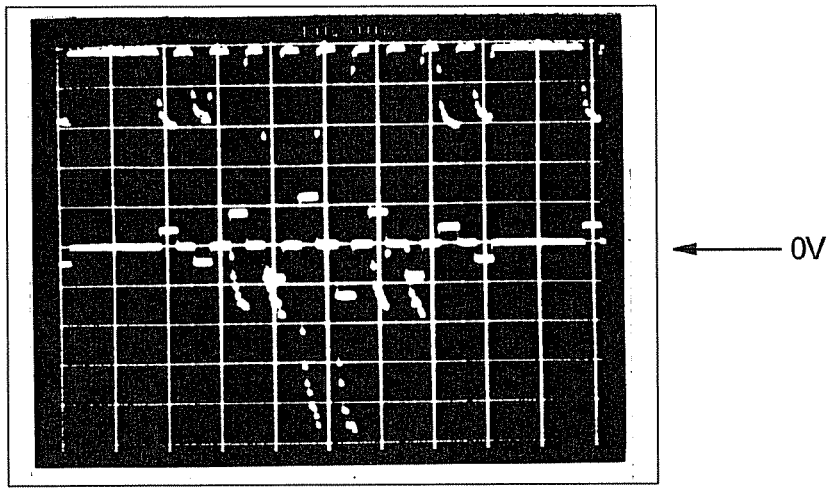
FIGS. 17A and 17B illustrate raw data of optical response of the thresholdless liquid crystal when the "0 V" reset period is provided of the present invention.
Figure 17B:
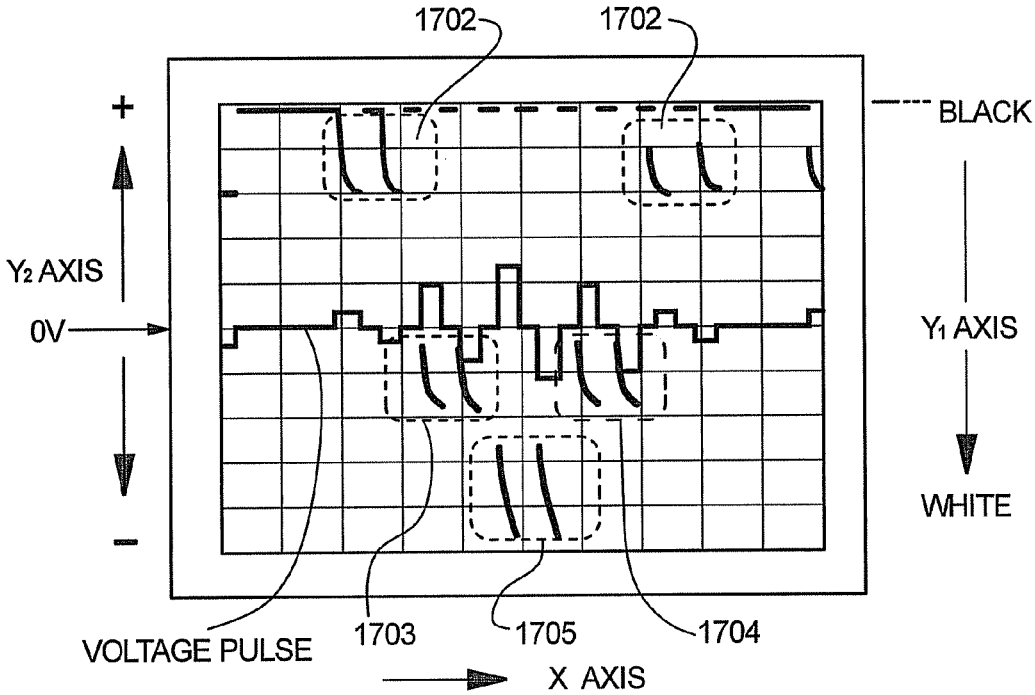

FIGS. 17A and 17B show an optical response of the thresholdless liquid crystal when the "0V" reset period is provided. FIGS. 17A and 17B are an oscilloscope photographs of the same liquid crystal cell when driven with a waveform different from that illustrated in FIG. 3A, where only the amplitude and the period of the voltage are changed. The applied waveform starts with 0 V, and goes through +1.6 V, −1.6 V, +3.2 V, −3.2 V, +4.8 V, −4.8 V, +3.2 V, −3.2 V, +1.6 V, and −1.6 V, with the polarity and the amplitude of the voltage being changed. In addition, after the second period where a voltage pulse 1710 the absolute value of which is more than zero is applied to perform gradation display is provided, the first period as the "0 V" reset period is inserted. Two waveforms shown by the oscilloscope clarify the relationship between an applied pulse and the optical response of the liquid crystal. A horizontal axis (referred to as an X axis) shows time, and one division of the scale is 25 msec. Vertical axes are referred to as Y axes. A first vertical axis (referred to as a $Y_1$ axis) for the optical response of the liquid crystal shows brightness measured with a photo multiplier, and one division of the scale is 10 mV. A second vertical axis (referred to as a $Y_2$ axis) for the amplitude of the applied pulse shows cell voltage, and one division of the scale is 4 V.

With regard to the optical response of liquid crystal, the brightness changes correspondingly to the absolute value of a voltage applied to the liquid crystal cell. When a voltage having a larger absolute value is applied to the liquid crystal cell, the optical response of the liquid crystal goes toward a higher white level, while, when a voltage having a smaller absolute value is applied to the liquid crystal cell, the optical response of the liquid crystal goes toward a higher black level. During the "0 V" reset period, i.e., the first period, the liquid crystal is switched to the reset position. In the oscilloscope display, optical responses 1701 and 1702 are observed when the voltage of ±1.6 V is applied, optical responses 1703 and 1704 are observed when the voltage of ±3.2 V is applied, and optical response 1705 is observed when the voltage of ±4.8 V is applied. There are periods of black display as the "0 V" reset periods between the optical responses 1701-1705 of the liquid crystal. When a voltage having a small absolute value is applied, the optical response of the liquid crystal is in a gradation close to the black level. As the absolute value of the applied voltage becomes larger, the white level goes higher. In Embodiment Mode 1, when voltages having the same absolute value are applied, the optical responses of the liquid crystal have almost the same brightness. Although the quantity of light in the optical response differs between the case where a voltage of +1.6 V is applied and the case where a voltage of −1.6 V is applied, the p-p (peak to peak) difference between the maximum quantity of light and the minimum quantity of light is as small as 2.2 mV.

Since thresholdless liquid crystal does not have the nature of a memory, the orientation of thresholdless liquid crystal when no voltage is applied to the liquid crystal cell should be always the same. However, actually, the black level differs between a case where 0 V is applied in driving and a case where no voltage is applied after driving. In particular, the thinner the orientation film thickness is (70 nm or less), the bigger the difference becomes between the orientation of black when the liquid crystal cell is driven and the orientation of black when the liquid crystal cell is not driven (Fukuda, Liquid Crystals, Vol. 25, LCT100975, 1998). This is a characteristic which is not observed with regard to liquid crystal having the nature of a memory such as tristable antiferroelectric liquid crystal and bistable ferroelectric liquid crystal. However, even when such voltage where such an unstable phenomenon is observed is set as the voltage during the reset period, there is no particular problem in gradation displayed by the thresholdless liquid crystal, and voltage-transmittance characteristics without the hysteresis are obtained. In other words, by providing, in the thresholdless liquid crystal, the "0 V" reset period where unstable orientation was expected, the effect of decreasing the hysteresis was actually obtained.

Comparative Example 1

The result of driving when the "0 V" reset period is not provided is described in the following.

FIGS. 6A and 6B are a sectional view and a top view of a liquid crystal cell, respectively. ITO 602 is patterned over a quartz substrate 601 at a film thickness of 120 nm. A low-pretilted orientation film 603 is formed on the ITO by printing, pre-baking, and post-baking the orientation film. The orientation film is treated to be rubbed. Since the axis of orientation of thresholdless liquid crystal tends to tilt from a rubbing axis by about 0-15°, rubbing axes 606 and 607 are crossed when a pair of substrates 601 are affixed to each other to fix the optical axis of the liquid crystal. In order to prevent orientation defects, no spacer is scattered. Sealing material 604 is provided at end portions of the liquid crystal cell with a space being formed between the two substrates. The cell gap of the liquid crystal cell is 2.0 μm. Polarizing plates 608 and 609 are affixed to the pair of substrates, respectively. The optical axis of the liquid crystal is, in the wavelength range of visible radiation, substantially parallel with the optical axis of the polarizing plate 608. Therefore, when no voltage is applied, if the polarizing plate 608 is disposed to be crossed Nicol, the liquid crystal cell displays black. Since cones of the liquid crystal are oriented randomly when no voltage is applied, the spontaneous polarization of the liquid crystal is canceled out as a whole. For the purpose of comparison, the orientation film thickness and the spontaneous polarization of the liquid crystal are the same as those used in Embodiment Mode 1, and thus, the liquid crystal material and the orientation film thickness are the same as those used in the data shown in FIGS. 3A and 3B.

Figure 1:
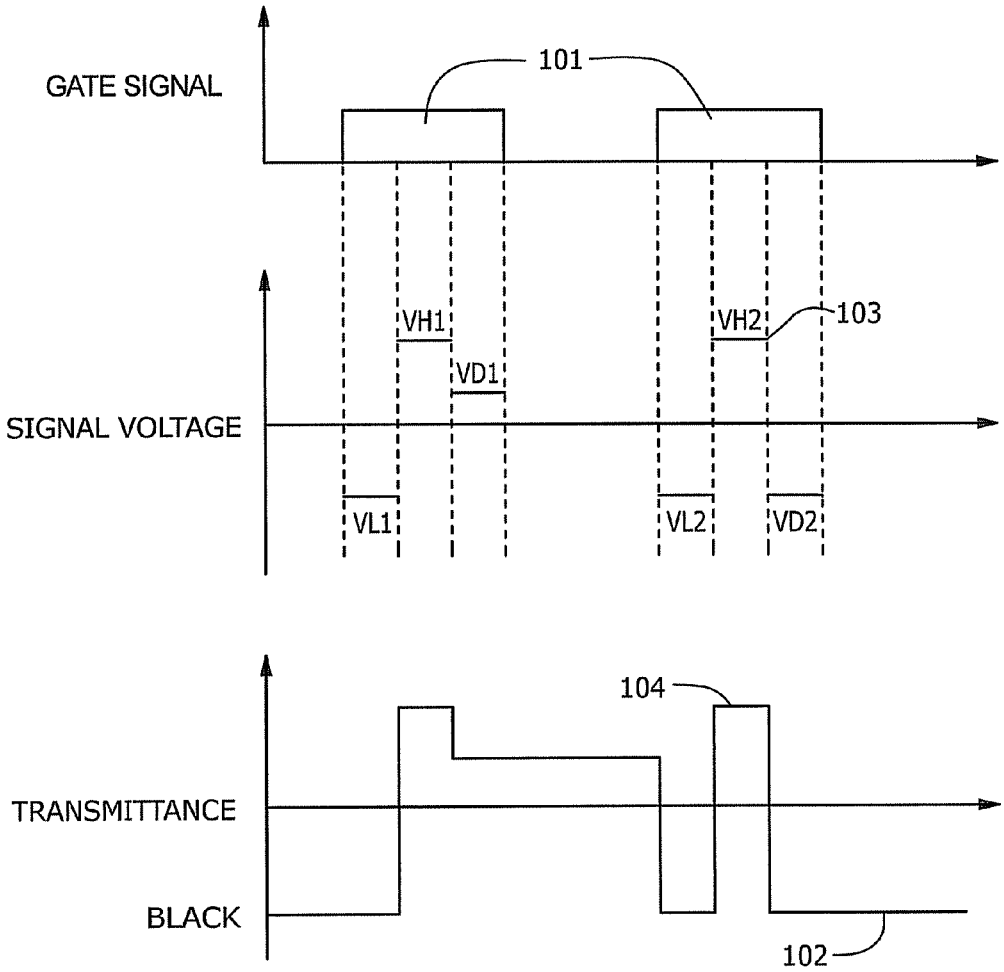
FIG. 1 PRIOR ART
FIG. 1 illustrates an example of a conventional driving method.
Figure 2A:
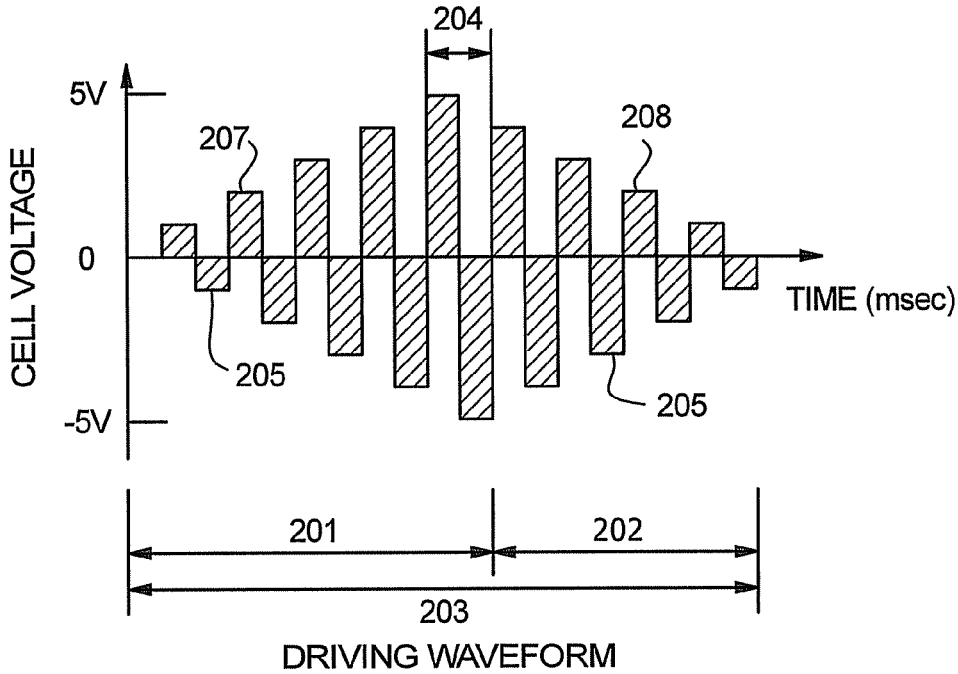
FIGS. 2A and 2B illustrate a driving waveform and the driving result when a "0 V" reset period is not provided of Comparative Example 1.
Figure 2B:
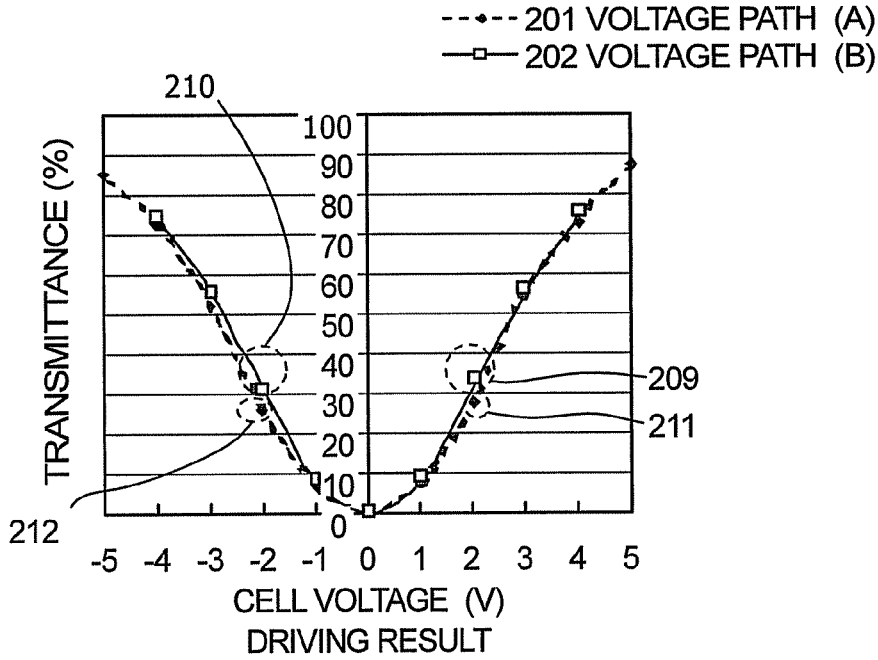

FIGS. 2A and 2B show the driving waveform and the driving result when the "0V" reset period is not provided. FIG. 2A illustrates a waveform applied in the present comparative example. A pair of alternating current pulses 204 having opposite polarities but the same absolute value are applied to the liquid crystal cell with the amplitude of the voltage being changed. Though a thin film transistor is driven by a constant charge, characteristics of such a thin film transistor was provisionally examined when the thin film transistor was driven by a constant current. In the constant current driving, when a voltage is applied to the liquid crystal cell, charge according to reversal of spontaneous polarization of the liquid crystal is supplied. The driving waveform was formed using the function generator "MODEL275" manufactured by Waveteck Co. Ltd. A voltage path (A) 201 starts with 0 V, and goes through +1 V, −1 V, +2 V, −2 V, +3 V, −3 V, +4 V, −4 V, and +5 V to reach −5 V. The polarity of voltage alternates between positive and negative, and the absolute value of the cell voltage applied to the liquid crystal cell is sequentially increased by 1 V. A voltage path (B) 202 starts with +4 V, and goes through −4 V, +3 V, −3 V, +2 V, −2 V, +1 V, and −1 V to reach 0 V. The polarity of voltage alternates between positive and negative, and the absolute value of the cell voltage applied to the liquid crystal cell is sequentially decreased by 1 V. The voltage having the waveform where the voltage paths (A) and (B) formed one cycle 203 was continuously applied to the liquid crystal cell. The width of pulses 205-208 was 16.6 msec.

The optical response when the pulse was applied to the liquid crystal cell was examined with a photo multiplier. Since the optical response of the liquid crystal and the waveform inputted to the liquid crystal cell are synchronously displayed on the oscilloscope, the transmittance of the liquid crystal for each voltage can be clarified.

The relationship between the voltage applied to the liquid crystal cell and the quantity of light is illustrated in the graph of FIG. 2B. Transmittance is plotted with regard to each cell voltage in FIG. 2B. Since the optical response of the liquid crystal changed over time during the application of the voltage to the liquid crystal cell, the final brightness reached was used as the transmittance. In a halftone display region with the cell voltage being 2 V −3 V, there is a shift in the voltage-transmittance characteristics (hysteresis) of 0.2 V at the maximum. In the alternative current driving, the average of a transmittance 211 of the positive pulse and a transmittance 212 of the negative pulse in the voltage path (A) and the average of a transmittance 209 of the positive pulse and a transmittance 210 of the negative pulse in the voltage path (B) with regard to the same voltage clearly differ from each other by up to 5% with regard to the same voltage of 2 V.

When the applied waveform illustrated in FIG. 2A and the optical response illustrated in FIG. 2B are reviewed correspondently to each other, it can be seen that the brightness shown by the same thresholdless liquid crystal differs depending on whether the absolute value of the preceding gradation display voltage is larger or smaller than that of the present gradation display voltage. More specifically, the transmittance 209 when the voltage transitions from the pulse 205 having a larger absolute value of (−3 V) to +2 V differs from the transmittance 211 when the voltage transitions from the pulse 206 having a smaller absolute value of (−1 V) to +2V.

Figure 13A:
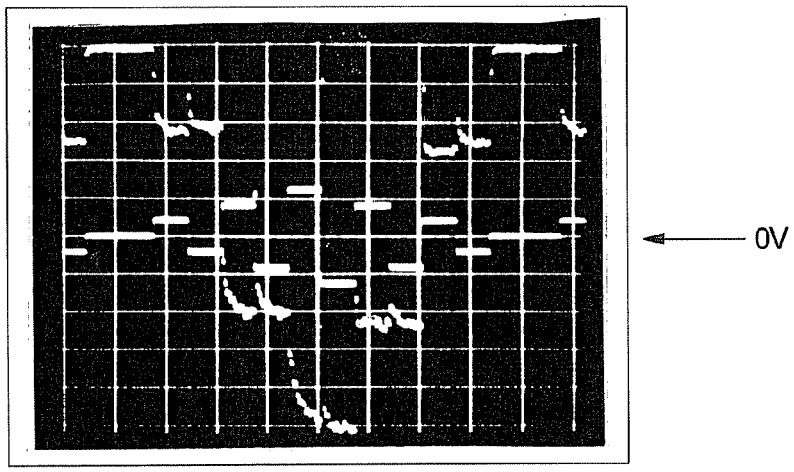
FIGS. 13A and 13B illustrate raw data of optical response of the thresholdless liquid crystal when the "0 V" reset period is not provided of Comparative Example 1.
Figure 13B:
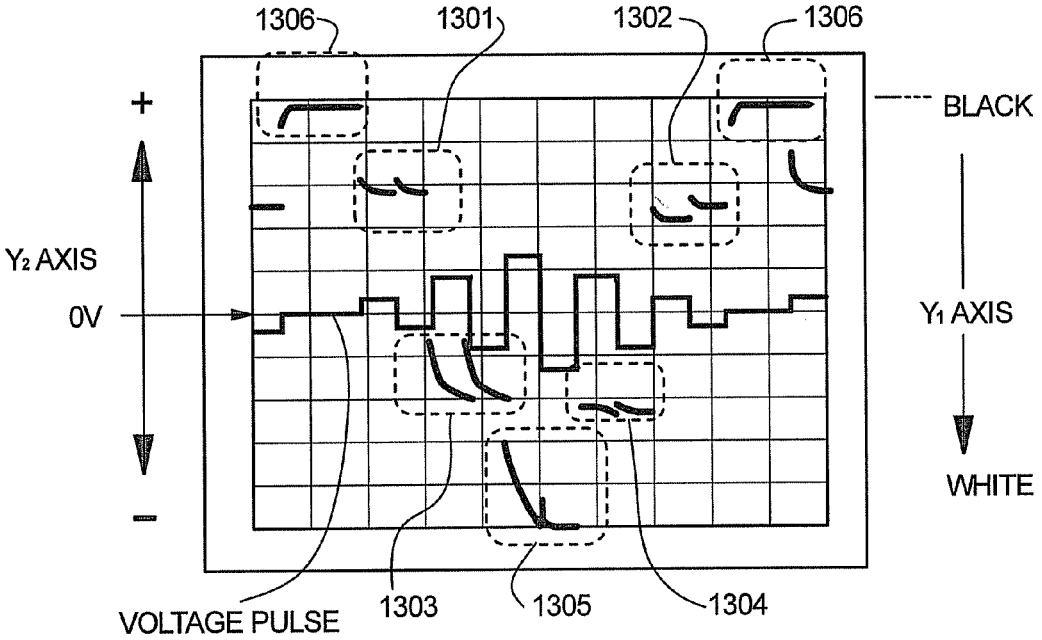

FIGS. 13A and 13B show an optical response of the thresholdless liquid crystal when the "0V" reset period is not provided. FIGS. 13A and B are oscilloscope photographs of the same liquid crystal cell when driven with a waveform different from that illustrated in FIG. 2A, where the amplitude of the voltage is changed. The applied waveform starts with 0 V, and goes through +1.6 V, −1.6 V, +3.2 V, −3.2 V, +4.8 V, −4.8 V, +3.2 V, −3.2 V, +1.6 V, and −1.6 V, with the polarity and the amplitude of the voltage being changed. Waveforms shown by the oscilloscope clarify the relationship between the voltage applied to the liquid crystal cell and the optical response of the liquid crystal. A horizontal axis (referred to as an X axis) shows elapse of time, and one division of the scale of the oscilloscope waveform is 25 msec. Vertical axes are referred to as Y axes. A first vertical axis (referred to as a $Y_1$ axis) for the optical response of the liquid crystal shows the brightness of the liquid crystal cell measured with a photo multiplier, and one division of the scale is 10 mV. A second vertical axis (referred to as a $Y_2$ axis) for the voltage applied to the liquid crystal cell shows cell voltage as defined herein, and one division of the scale is 4 V.

The brightness of the liquid crystal cell changes over time correspondingly to the voltage applied to the liquid crystal cell. The liquid crystal cell is in the normally black mode. When a voltage having a larger absolute value is applied, the liquid crystal is switched toward a higher white level, while, when a voltage having a smaller absolute value is applied, the liquid crystal is switched toward a higher black level. In the waveforms displayed on the oscilloscope, optical responses 1301 and 1302 of the liquid crystal are observed when a voltage of ±1.6 V is applied, optical responses 1303 and 1304 of the liquid crystal are observed when a voltage of ±3.2 V is applied, and optical response 1305 of the liquid crystal is observed when a voltage of ±4.8 V is applied. The absolute value of the voltage applied to the liquid crystal cell starts with 0 V, and is increased by 1.6 V. After the voltage of ±4.8 V is applied, the absolute value of the voltage applied to the liquid crystal cell is decreased by 1.6 V. According to this change, the liquid crystal cell gradually becomes brighter from a black level 1306 of the optical response of the liquid crystal, and the white level of the optical response 1305 of the liquid crystal reaches the maximum when the voltage of ±4.8 V is applied. Then, as the absolute value of the voltage applied to the liquid crystal cell becomes smaller, the white level becomes lower through the optical responses 1304 and 1302 of the liquid crystal in this order. Even when the same voltage is applied to the liquid crystal cell, the quantity of light of the liquid crystal cell changes to some extent. The difference in the quantity of light of the optical response of the liquid crystal is large when the voltage of ±1.6 V is applied, where the p-p (peak to peak) difference between the maximum quantity of light and the minimum quantity of light is as large as 5.8 mV. In particular, compared with the case of the optical response of the liquid crystal illustrated in FIGS. 17A and 17B where the "0 V" reset period is introduced, the difference in the quantity of light of the optical responses 1301 and 1302 of the liquid crystal when the voltage having the absolute value of 1.6 V is applied is large.

By comparing Comparative Example 1 and Embodiment Mode 1, it can be seen that the provision of the "0 V" reset period is useful. The "0 V" reset period suppresses the hysteresis.

Embodiment 1

In Embodiment 1, in an active matrix driving with the driving voltage being limited, the thresholdless liquid crystal having a small spontaneous polarization is used for the purpose of securing a satisfactory white level even if the auxiliary capacitor is small. The present invention is applied to such liquid crystal having a small spontaneous polarization. Though the hysteresis is liable to occur when the spontaneous polarization is small, by applying the present invention, satisfactory gradation display can be performed. At the same time, the response time of the liquid crystal can be improved to be shorter.

FIGS. 6A and 6B a sectional view and a top view of a liquid crystal cell, respectively. ITO 602 is patterned over a quartz substrate 601 at a film thickness of 120 nm. A low-pretilted orientation film 603 is printed, pre-baked, and post-baked on the ITO. The surface of the orientation film is treated to be rubbed. Since the axis of orientation of thresholdless liquid crystal tends to tilt from a rubbing axis by about 0-15°, rubbing axes 606 and 607 are crossed in a pair of substrates 601 to make the optical axis of the liquid crystal substantially in parallel in the cell width direction. In order to prevent orientation defects, no spacer is scattered. A gap is secured only by sealing material 604, and the cell gap is 2.0 μm when completed. Polarizing plates 608 and 609 are affixed to the pair of substrates, respectively. The optical axis of the liquid crystal is, in the wavelength range of visible radiation, substantially parallel with the optical axis of the polarizing plate 608. Therefore, when no voltage is applied, if the polarizing plate 608 is disposed to be crossed Nicol, the liquid crystal cell displays black. Further, since cones of the liquid crystal are oriented randomly when no voltage is applied, the spontaneous polarization of the liquid crystal is canceled out as a whole. In this embodiment, the orientation film thickness is made thinner and the spontaneous polarization of the liquid crystal is made smaller for optimization to make the white level satisfactory in active matrix driving. The orientation film thickness after post-bake is 60 nm, and the spontaneous polarization of the liquid crystal 605 is 40 $nC/cm^2$.

Figure 11A:
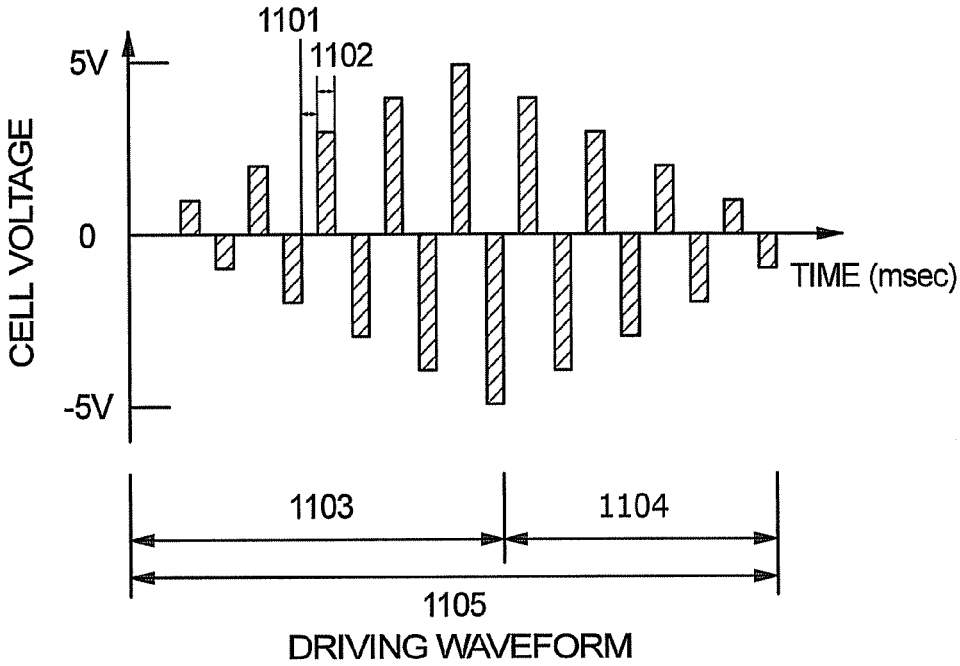
FIGS. 11A and 11B illustrate a driving waveform and the driving result when the "0 V" reset period is provided with regard to driving of thresholdless liquid crystal having a small spontaneous polarization of Embodiment 1.
Figure 11B:
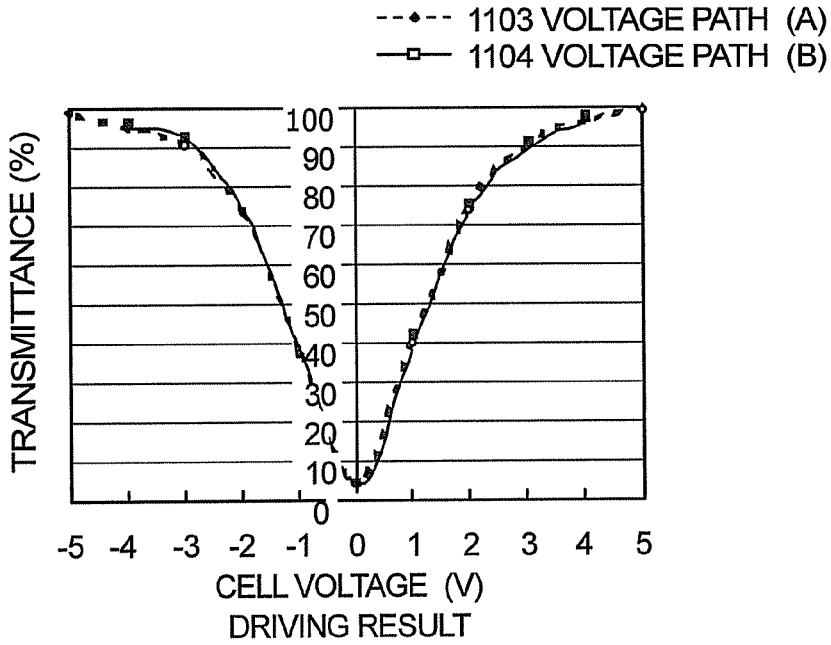

A driving waveform was formed using the function generator "MODEL275" manufactured by Waveteck Co. Ltd. Though a thin film transistor is driven by a constant charge, characteristics of such a thin film transistor was provisionally examined when the thin film transistor was driven by a constant current. Since the thin film transistor is driven by a constant current, charge according to reversal of spontaneous polarization of the liquid crystal is supplied during a pulse period. FIGS. 11A and 11B show the driving waveform and the driving result when the "0V" reset period is provided in a case that the spontaneous polarization of the liquid crystal is 40 $nC/cm^2$. FIG. 11A illustrates a driving waveform that drove the liquid crystal cell. Before a second period where gradation is displayed by a gradation display pulse 1102, there is a first period 1101 as a "0 V" reset period. In the experiment, pulse width 1102 and a reset period 1101 were both set to 8.3 msec. A voltage path (A) 1103 starts with 0 V, and goes through +1 V, −1 V, +2 V, −2 V, +3 V, −3 V, +4 V, −4 V, and +5 V to reach −5 V. The polarity of voltage alternates between positive and negative, and the absolute value of the cell voltage applied to the liquid crystal cell is sequentially increased by 1 V. A voltage path (B) 1104 starts with +4 V, and goes through −4 V, +3 V, −3 V, +2 V, −2 V, +1 V, and −1 V to reach 0 V. The polarity of voltage alternates between positive and negative, and the absolute value of the cell voltage applied to the liquid crystal cell is sequentially decreased by 1 V. The voltage having the waveform where the voltage paths (A) and (B) formed one cycle 1105 was continuously applied to the liquid crystal cell, with the waveform of one cycle being the unit.

The optical response when the voltage was applied to the liquid crystal cell was examined with a photo multiplier. Since the optical response of the liquid crystal and the waveform inputted to the liquid crystal cell are synchronously displayed on the oscilloscope, the transmittance of the liquid crystal for each cell voltage can be clarified.

The relationship between the voltage applied to the liquid crystal cell and the quantity of light is illustrated in the graph of FIG. 11B. Transmittance is plotted with regard to each cell voltage in FIG. 11B. Since the optical response of the liquid crystal changed over time during application of the voltage, the final brightness reached was used as the transmittance. In FIG. 11B, the voltage applied to the liquid crystal and the orientation film when the liquid crystal cell was driven was used as the cell voltage.

By providing the "0 V" reset period, satisfactory gradation display can be performed with almost no difference in brightness between the voltage paths (A) and (B).

As a first effect, the thresholdless liquid crystal having the spontaneous polarization of 40 nC/cm$^2$ optimized to be driven in an active matrix panel, with the driving voltage being limited, has an orientation film thickness of 60 nm, which is comparatively thin. Therefore, the hysteresis is comparatively more liable to occur. However, by providing the "0 V" reset period, display with almost no hysteresis can be performed.

Next, as a second effect of this embodiment, by providing the "0 V" reset period with regard to the thresholdless liquid crystal, not only the hysteresis but also the response time can be improved.

Figure 12A:
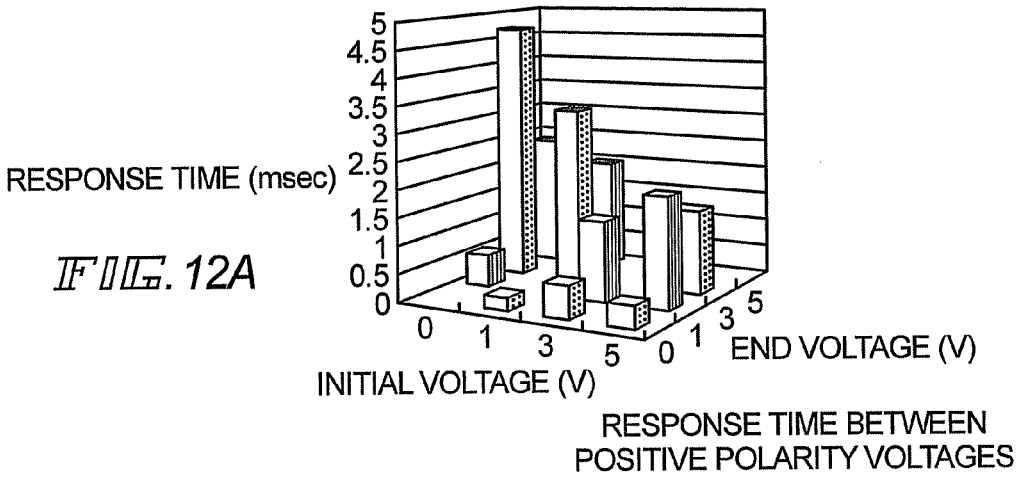
FIGS. 12A to 12C illustrate response time of the thresholdless liquid crystal having a small spontaneous polarization of Embodiment 1.
Figure 12B:
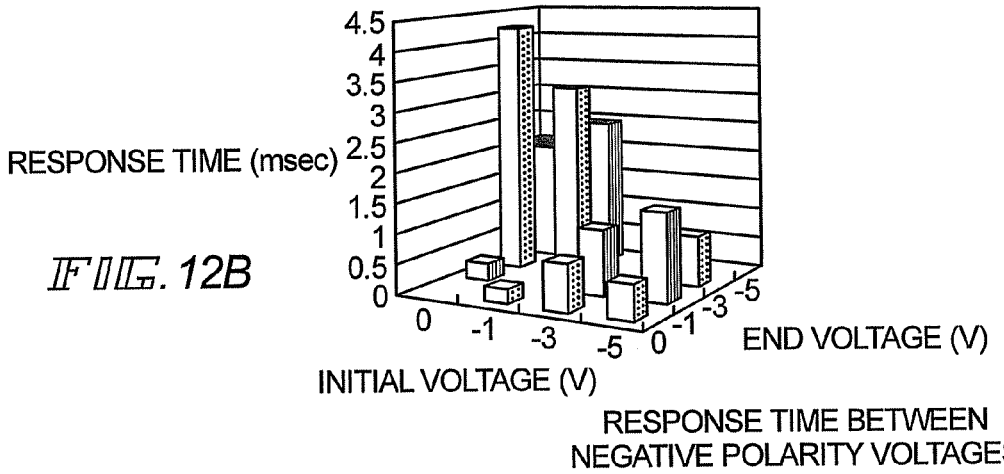
Figure 12C:
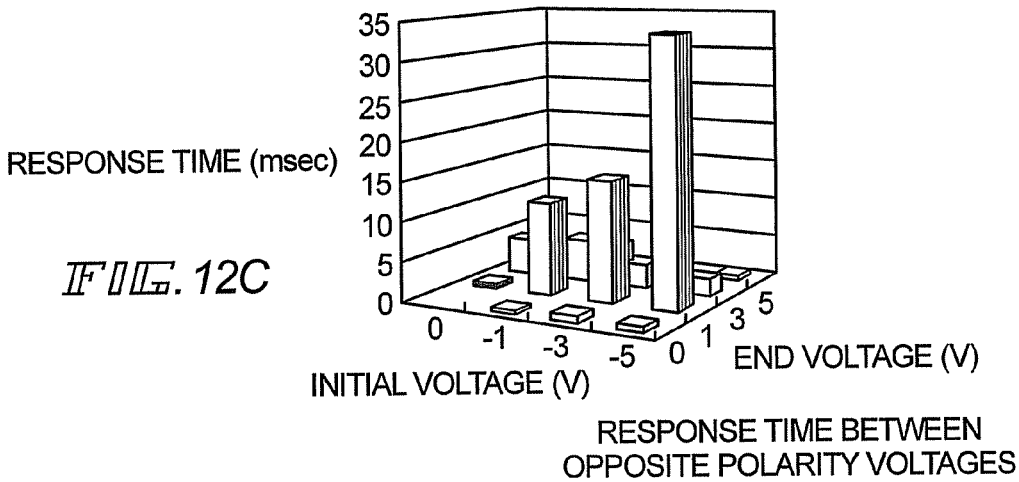

FIGS. 12A to 12C illustrate the result of measuring the response time of the present liquid crystal. FIG. 12A shows the response time between positive polarity voltages, FIG. 12B shows the response time between negative polarity voltages, and FIG. 12C shows the response time between opposite polarity voltages. Each drawing of FIGS. 12A to 12C indicates the relationship of initial voltages, end voltages and response time. The liquid crystal cell is structured such that the spontaneous polarization of the liquid crystal is 40 nC/cm$^2$ and the orientation film thickness after post-bake is 60 nm, which are the same as those of the liquid crystal cell in the data shown in FIG. 11B. Examination of the response time in switching from a positive voltage to a negative voltage (see FIG. 12C) revealed that the response time is particularly long when the voltage transitions from −5 V to +1 V (32 msec). Also, switching from −3 V to +1 V took as much time as 15.6 msec. With regard to the thresholdless liquid crystal, switching between opposite polarity voltages particularly takes much time in case of (1) switching from the white level to a halftone and (2) switching between halftones. When a comparison is made with regard to various spontaneous polarization of the liquid crystal, such a tendency is outstanding with regard to liquid crystal having the small spontaneous polarization of 40 nC/cm$^2$, as in this embodiment. Since the response time tends to become longer when the spontaneous polarization is smaller, such a tendency is thought to be more outstanding when the spontaneous polarization is 40 nC/cm$^2$.

When thresholdless liquid crystal is driven by an active element such as a thin film transistor, in order to prevent burn-in due to a stored direct current component in the liquid crystal, alternate current driving is generally performed. More specifically, as shown in FIG. 12C, a positive voltage and a negative voltage are alternately applied to the liquid crystal panel. Therefore, if the response time of the liquid crystal is long between the positive and negative voltages (i.e., voltages of opposite polarities), it is difficult to display a dynamic image naturally.

However, if the liquid crystal is switched via the "0 V" reset period according to the present invention, the response time can be improved. More specifically, when the liquid crystal is directly switched from −5 V to +1 V, the response time is as much as 32 msec. Since switching from −5 V to 0 V takes 0.4 msec and switching from 0 V to +1 V takes 0.3 msec, when the liquid crystal is switched from −5 V to 0 V and then from 0 V to +1 V, the response time in total can be shortened to 0.7 msec.

When the liquid crystal is directly switched from −3 V to +1 V, the response time of the liquid crystal is as much as 15.6 msec. Since switching from −3 V to 0 V takes 2.6 msec and switching from 0 V to +1 V takes 0.3 msec, when the liquid crystal is switched from −3 V to 0 V and then from 0 V to +1 V, the response time in total can be shortened to 2.9 msec.

In this way, it can be seen that the response time when the "0 V" reset period is provided is five times or more as short as that when the "0 V" reset period is not provided. More specifically, though the response time between the first voltage of −3 V and the second voltage of +1 V having the opposite polarity to that of the first voltage is 15.6 msec, the response time of the same liquid crystal when 0 V intervenes between the first voltage and the second voltage is 2.9 msec, which is more than five times as short as that in the former case.

Of course, the "0 V" reset period can be set such that the liquid crystal can return to the reset position during that period. For example, with regard to the liquid crystal having the response characteristics illustrated in FIGS. 12A to 12C, since its maximum response time from 5 V or lower to 0 V is 2.6 msec, the "0 V" reset period may be set to be 2.6 msec and the gradation display period may be set to be 14 msec. By providing within one frame the "0 V" reset period of 2.6 msec and the gradation display period of 14 msec as subframes, the liquid crystal can be switched to a predetermined gradation in one frame.

In this way, as the second effect of providing the "0 V" reset period, when alternate current driving is performed with regard to liquid crystal the response time of which is long from the white level to a halftone or between halftones, by providing the "0 V" reset period, the response time can be improved. Of course, even when direct current driving is performed, if it takes a considerably longer time in switching the liquid crystal between halftones compared with a case where the liquid crystal is switched between halftones via 0 V, the effect of improving the response time can be expected by providing the "0 V" reset period according to the present invention.

Embodiment 2

In order to make effective the effect of the "0 V" reset period in a panel having the hysteresis, it is necessary that the liquid crystal is in a predetermined position or near the predetermined position during the reset period. In this embodiment, a material was used where the response time ($T_3$) when the liquid crystal relaxed to "0 V" was shorter than the response time ($T_4$) when the liquid crystal responded to an electric field ($T_3<T_4$), to make the black display period by the reset period ($T_1$) shorter than the gradation display period ($T_2$), that is, ($T_1<T_2$), thereby making the panel brighter.

Figure 4A:
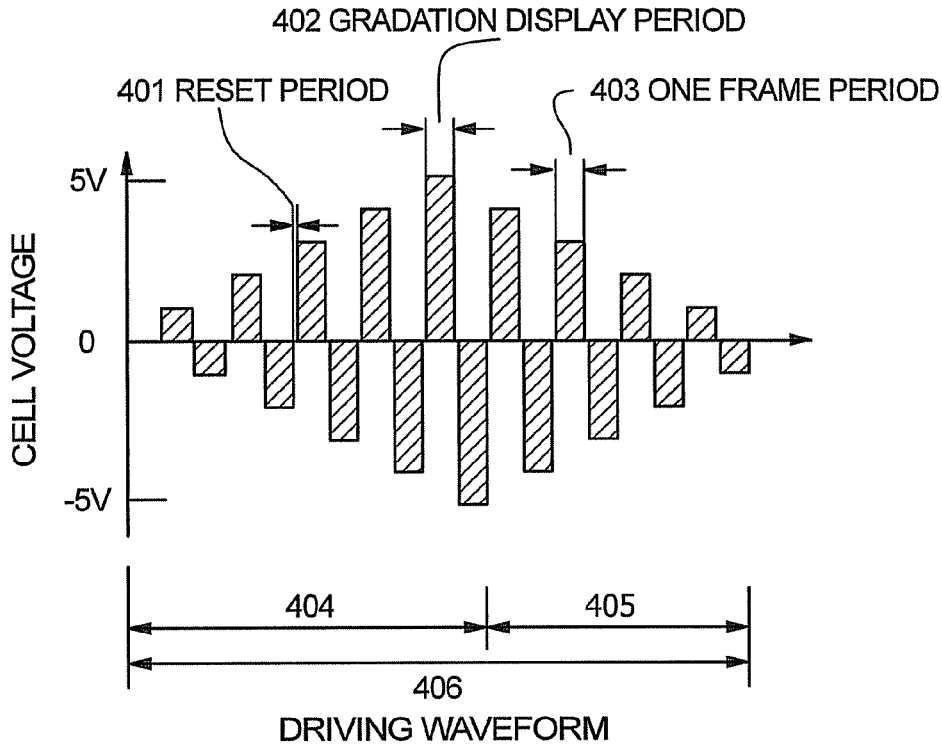
FIGS. 4A and 4B illustrate a driving waveform and the driving result when the "0 V" reset period is shortened of Embodiment 2.
Figure 4B:
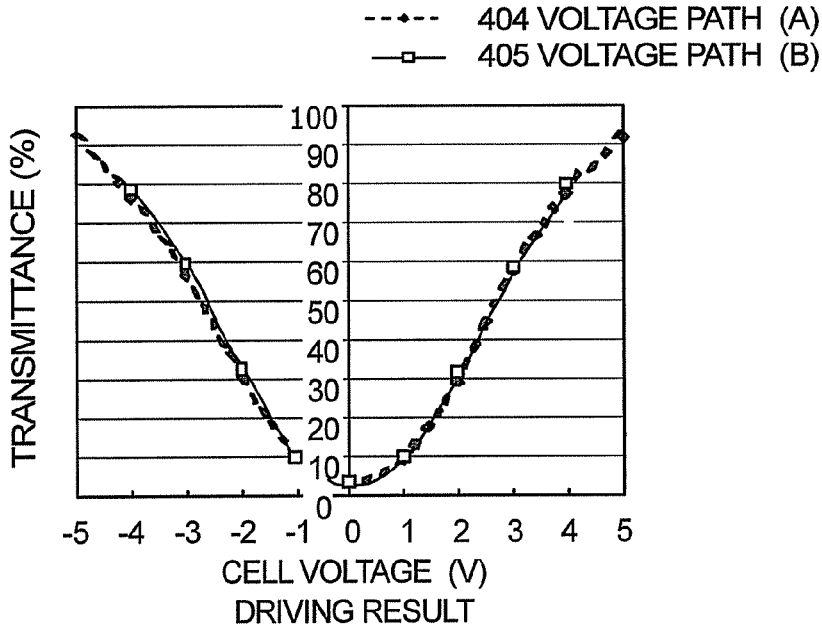

A driving waveform was formed using the function generator "MODEL275" manufactured by Waveteck Co. Ltd. Since constant current driving is performed, charge according to reversal of spontaneous polarization of the liquid crystal is supplied during a pulse period. FIGS. 4A and 4B show the driving waveform and the driving result when the "0V" reset period is short, in the case that the reset period is 2 msec and the gradation display period is 14.6 msec. FIG. 4A illustrates a driving waveform in the present experiment. Before a second period 402 for gradation display by a gradation display pulse, there is a first period 401 as a "0 V" reset period. It is characteristic that, while one frame period 403 is 16.6 msec, the reset period 401 is 2 msec, which is about ⅛ of one frame period. A voltage path (A) 404 starts with 0 V, and goes through +1 V, −1 V, +2 V, −2 V, +3 V, −3 V, +4 V, −4 V, and +5 V to reach −5 V. The polarity of voltage alternates between positive and negative, and the absolute value of the cell voltage applied to the liquid crystal cell is sequentially increased by 1 V. A voltage path (B) 405 starts with +4 V, and goes through −4 V, +3 V, −3 V, +2 V, −2 V, +1 V, and −1 V to reach 0 V. The polarity of voltage alternates between positive and negative, and the absolute value of the cell voltage applied to the liquid crystal cell is sequentially decreased by 1 V. The voltage having the waveform where the voltage paths (A) and (B) formed one cycle 406 was continuously applied to the liquid crystal cell, with the waveform of one cycle being the unit. The spontaneous polarization of the liquid crystal is 100 nC/cm$^2$ and the orientation film thickness is 60 nm, which are the same as those of Embodiment Mode 1.

Transmittance is plotted to each cell voltage with regard to each gradation display pulse in the graph of FIG. 4B. Since the optical response of the liquid crystal changed over time during application of the voltage pulse, the final brightness reached was used as the transmittance. Compared with the case shown in FIGS. 2A and 2B where the "0 V" reset period is not provided, the difference in brightness between the voltage paths (A) and (B) is improved particularly at the voltage of 2 V. Due to the noise of the photo multiplier, the measured transmittance of the black level was lower than that in FIGS. 2A and 2B by 2%, but the actual black displayed in this case was almost the same as that in the case of FIGS. 2A and 2B. Although the reset period was shorter than the gradation display period, the gradation display was performed with no problem. Since the black display period by the reset period is shortened, the brightness of the panel is improved.

In this embodiment, by using liquid crystal having a large spontaneous polarization, the response time during which the liquid crystal is reset to "0 V" is made shorter to shorten the reset period of the black display. In order to make the response time shorter, other than enlarging the spontaneous polarization, the panel temperature may be raised, thereby to decrease the viscosity of the liquid crystal, as in a projector panel.

Embodiment 3

Embodiment 3 is characterized in that it is a driving method which prevents burn-in of the liquid crystal and suppresses the hysteresis.

Figure 14:
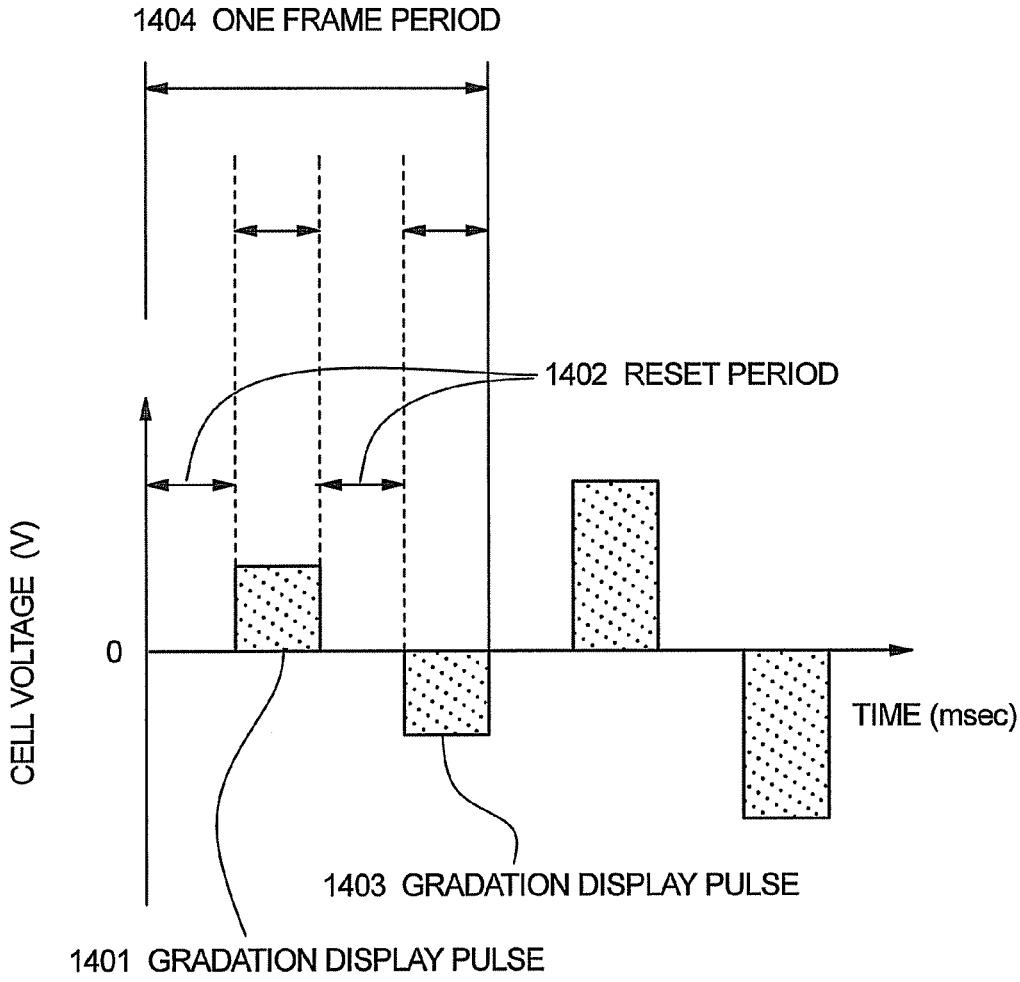
FIG. 14 illustrates an example of driving according to the present invention which prevents burn-in of Embodiment 3.

The structure of the cell used in the experiment was the same as that illustrated in FIG. 6. As liquid crystal 605, the same one used in collecting the data in the graphs of FIGS. 2A to 4B was used. A driving waveform was formed using the function generator "MODEL275" manufactured by Waveteck Co. Ltd., which can freely program a waveform to be applied. Since constant current driving is performed, charge according to reversal of spontaneous polarization of the liquid crystal is supplied during a pulse period. FIG. 14 illustrates an applied pulse in the present experiment. One frame period 1404 consists of four subframes 1401-1403. Before a second period for gradation display by a gradation display pulse 1401 or 1403, a first period 1402 as a "0 V" reset period is provided to return the liquid crystal to a reset position of "0 V". It is characteristic that, in one frame 1404 of 16.6 msec, alternate current driving is performed by the voltage pulses 1401 and 1403 which have the same absolute value but opposite polarities.

Even when one frame period of 16.6 msec is divided into four subframes, since the response time of the liquid crystal is short, the liquid crystal returns to the predetermined reset position during the reset period (4.15 msec), and satisfactory gradation display can be performed. Further, since direct current components are canceled out in one frame period, satisfactory gradation display can be performed with less liability to burn-in even in display for a long time. The reset period may be provided after a gradation display pulse to return the liquid crystal to the reset position of "0 V" after image data is written by the gradation display pulse.

Comparative Example 2

In the present comparative example, optical response when the reset voltage is 1 V is examined, and a comparison is made with the case where the "0 V" reset period is provided.

Figure 5A:
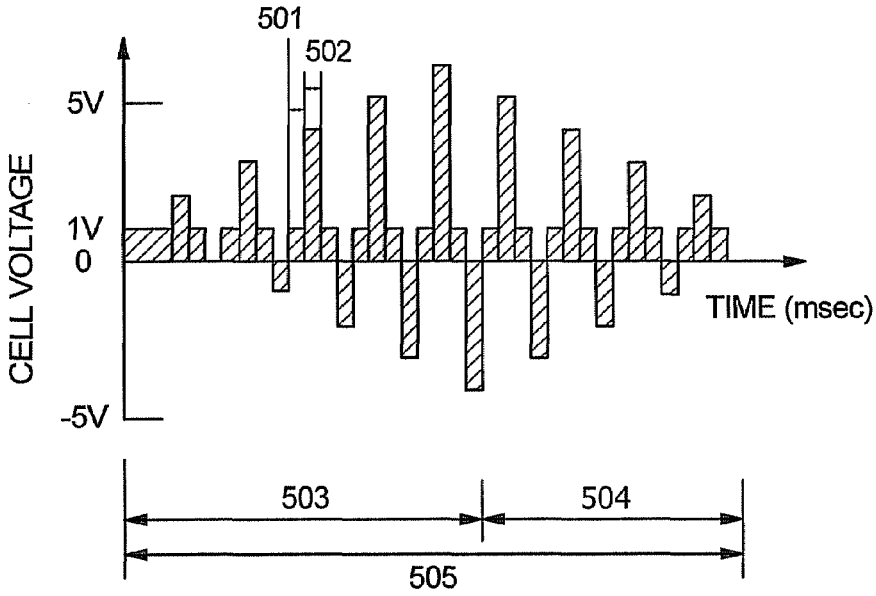
FIGS. 5A and 5B illustrate a driving waveform and the driving result when a "1 V" reset period is provided of Comparative Example 2.
Figure 5B:
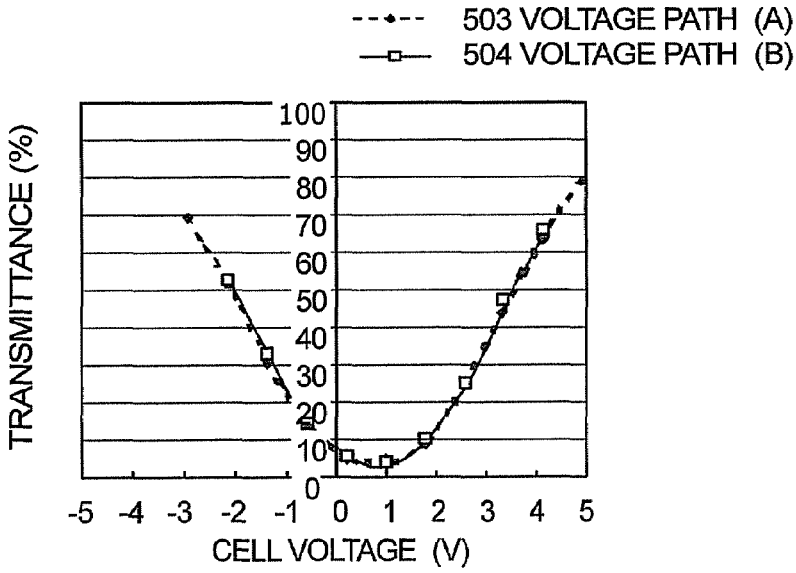

The structure of the cell used in the experiment is the same as that illustrated in FIG. 6. For the purpose of making a comparison, the same cell as used in collecting the data in FIGS. 2A to 4B was used. The material of the liquid crystal and the orientation film thickness are the same as those used in collecting the data in FIGS. 2A to 4B. FIGS. 5A and 5B show the driving waveform and the driving result when the reset voltage of 1V is provided. FIG. 5A illustrates a driving waveform. The reset voltage is 1 V. Though an active matrix substrate is driven by constant charge, the experiment is provisionally made with regard to constant current driving. A waveform to be applied was formed using the function generator "MODEL275" manufactured by Waveteck Co. Ltd. Pulse widths 501 and 502 were both 8.3 msec. A voltage path (A) 503 starts with +1 V, and goes through +2 V, 0 V, +3 V, −1 V, +4 V, −2 V, +5 V, −3 V, and +6 V to reach −4 V. With +1 V being the reset voltage, the positive voltages to be applied are sequentially increased by 1 V, while the negative voltages to be applied are sequentially decreased by 1 V. The direction of the increase is toward the larger difference between the reset voltage and the voltage to be applied. Conversely, a voltage path (B) 504 starts with +4 V, and goes through −3 V, +3 V, −2 V, +2 V, and −1 V, to reach +2 V. With +1 V being the reset voltage, the positive voltages to be applied are sequentially decreased by 1 V, while the negative voltages to be applied are sequentially increased by 1 V. The direction of the decrease is toward the smaller difference between the reset voltage and the voltage to be applied. The waveform where the voltage paths (A) and (B) formed one cycle 505 was continuously applied to the liquid crystal cell, with one cycle being the unit.

The relationship between the cell voltage applied to the liquid crystal cell and the transmittance of the liquid crystal cell is illustrated in the graph of FIG. 5B. Though the hysteresis due to the voltage path is small, the cell voltage-transmittance characteristics shift from 0 V to the positive voltage side. If the thresholdless liquid crystal is driven with such cell voltage-transmittance characteristics, direct current component is stored, which is a cause of burn-in.

In driving the thresholdless liquid crystal, if a voltage pulse of a single polarity is a reset pulse, the cell voltage-transmittance characteristics shift. This makes it clear that to provide the "0 V" reset period having no polarity is also effective in preventing a shift in the voltage-transmittance characteristics.

Embodiment 4

The present invention is applied to an active matrix panel and the effect is examined. The standard of the panel is VGA (640×480 pixels). The pixel pitch is 42 μm×126 μm. The liquid crystal of the data in FIGS. 11A and 11B having the spontaneous polarization of 40 nC/cm$^2$ is used, and the orientation film thickness is 60 nm.

In driving the thresholdless liquid crystal, when the liquid crystal can not be fully reversed during a scanning line selection period, the spontaneous polarization is reversed using charge stored in the auxiliary capacitor of the thin film transistor. If the auxiliary capacitor is too small, the charge in the capacitor with the liquid crystal layer being a dielectric is not sufficiently stored, the reversal of spontaneous polarization becomes insufficient, whereby the white level is lowered. Therefore, it is desirable that the auxiliary capacitor is large to some extent. In this embodiment, as the auxiliary capacitor, one having the capacitor per unit pixel area of 0.48 fF/μm$^2$, which is comparatively large, is used.

The structure of a thin film transistor substrate according to Embodiment 4 is described in the following. The structure of the thin film transistor is not limited to the one described in the following. For example, though a top-gate type thin film transistor is illustrated in this embodiment, the thin film transistor may be a bottom-gate type.

Figure 15:
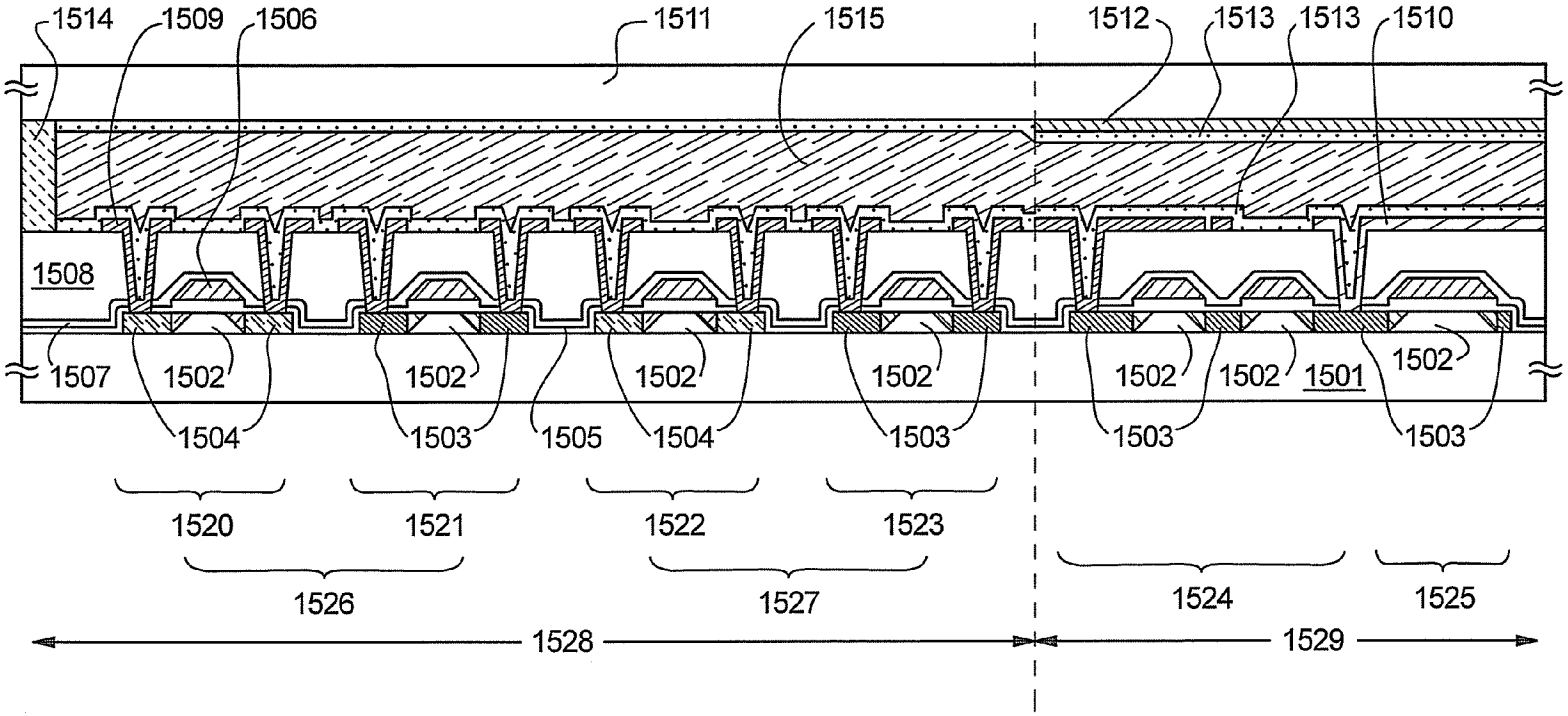
FIG. 15 illustrates an active matrix panel of Embodiment 4.

In FIG. 15, as a substrate 1501, a glass substrate of barium borosilicate glass or aluminoborosilicate glass represented by Corning #7059 glass or #1737 glass can be used. A base film (not shown) may be formed on the glass substrate for the purpose of preventing the glass substrate from being influenced by movable ions such as sodium ions.

Active layers of thin film transistors are formed on the glass substrate. The active layers are formed of silicon semiconductor film at a thickness of 25-80 nm (preferably 30-60 nm). Though both a-Si (amorphous silicon) and poly-Si (polycrystalline silicon) can be used as the active layers of the thin film transistors, in this embodiment, polycrystalline silicon is used, since it has lower resistance than that of amorphous silicon and thus writing current can be made larger. The writing current is 1 μA when the voltage is 5 V. The active layers with impurity doped therein are used as capacitor electrodes for auxiliary capacitors 1525. As the need arises, a mask such as a resist is provided on the active layers and impurity is doped therein to form impurity regions and channel regions. In FIG. 15, an intrinsic semiconductor layer region 1502, an n-type impurity region 1503, and a p-type impurity region 1504 are provided in the active layers. In addition, a low concentration impurity regions may be also formed in the active layers.

A gate insulating film 1505 is formed using plasma CVD or sputtering as an insulating film containing silicon. Since the gate insulating film also serves as an insulating film for forming an auxiliary capacitor 1525, the gate insulating film is preferably a silicon nitride film having a high permittivity of about 7. With regard to the thickness of the gate insulating film, a thinner film thickness is desirable in order to make larger the auxiliary capacitor, but, from the viewpoint of preventing short circuit and puncture, the film thickness can not be made so thin. In this embodiment, the thickness of the insulating film is 30 nm. The area of the auxiliary capacitor of Embodiment 4 is 784 μm$^2$. The auxiliary capacitor per unit pixel area of Embodiment 4 is, through calculation using the thickness and the permittivity of the insulating film material, 0.48 fF/μm$^2$. The capacitor is 376 fF. Such a large capacitor makes it possible to drive the spontaneous polarization liquid crystal according to Embodiment 4 in a panel of the VGA level.

A heat-resistant conductive layer 1506 is on the gate insulating film 1505 and forms a scanning electrode (a gate electrode) and a capacitor electrode of an auxiliary capacitor. The heat-resistant conductive layer may be a single layer, and, if necessary, may be of a laminated structure formed of a plurality of layers such as two layers and three layers. The conductive layer may be formed of an element selected from a group of tantalum (Ta), titanium (Ti), molybdenum (Mo), and tungsten (W), an alloy having the above element(s) as its main component, or an alloy which is a combination of the above elements (typically an Mo—W alloy film or an Mo—Ta alloy film). In this embodiment, as the heat-resistant conductive layer 1506, tantalum is formed to a thickness of 350 nm. In this embodiment, the scanning line, which is formed of the heat-resistant conductive layer 1506, and the active layer crosses a plurality of times so that the active layer has a plurality of intrinsic semiconductor regions.

A protective insulating film 1507 is on the heat-resistant conductive layer 1506 and the gate insulating film 1504. The protective insulating film may be formed of a silicon oxide film, a silicon nitride oxide film, a silicon nitride film, or a laminated film as a combination thereof. In any case, the protective insulating film 1507 is formed of an inorganic insulating material. The thickness of the protective insulating film 1507 is 100-200 nm.

An interlayer insulating film 1508 formed of an organic insulating material is on the protective insulating film 1507. Since an organic resin material generally has a low permittivity, parasitic capacitor can be decreased. However, since it is hygroscopic and inappropriate as a protective film, it is required to be used, as in this embodiment, in combination with a silicon oxide film, a silicon nitride oxide film, a silicon nitride film, or the like formed as the protective insulating film 1507.

The orientation of thresholdless liquid crystal is greatly influenced by the unevenness of the surface. Since orientation defects are induced by a difference in pre-tilt due to unevenness of the surface, it is desirable that the surface of the oriented liquid crystal is as planar as possible. Therefore, it is desirable that the thickness of the interlayer insulating film 1508 formed of an organic insulating material and has a planarizing effect is 1000-6000 nm. As the thickness of the interlayer insulating film 1508 becomes thicker, the effect of planarizing the surface of the oriented liquid crystal becomes larger. Thus, it is desirable that the thickness of the organic resin film is made as thick as possible so long as a considerable problem is not caused in the process.

A contact hole is formed in the interlayer insulating film 1508 and a transparent pixel electrode 1510 formed of ITO, for example, is patterned to provide a function to control, with a voltage, the orientation of the liquid crystal. Further, a signal electrode 1509 is also patterned on the same insulating film. It is desirable that, as the signal electrode, metal having a small resistance is used so that rounding of a signal waveform can be prevented. As a result, a logic circuit portion 1526 having a first p-channel thin film transistor 1520 and a first n-channel thin film transistor 1521, a sampling circuit portion 1527 having a second p-channel thin film transistor 1522 and a second n-channel thin film transistor 1523, a pixel thin film transistor 1524 and the auxiliary capacitor 1525 are formed. Over an active matrix substrate, the logic circuit portion 1526 and the sampling circuit portion 1527 are formed in a driver circuit portion 1528, and the pixel thin film transistor 1524 and the auxiliary capacitor 1525 are formed in a pixel portion 1529.

A black matrix (not shown) may be provided on an opposing substrate 1511 of the active matrix panel for the purpose of preventing a light leakage at the black level due to orientation defects of the liquid crystal. In particular, because orientation defects are remarkable where there is surface unevenness in thresholdless liquid crystal, it is preferable that such a black matrix is provided where the surface unevenness of thin film transistors is large. Materials of the black matrix includes chrome, chrome oxide, and resin BM. When resin BM is adopted in a direct-view type panel, reflection of surrounding light due to light reflection by the black matrix can be prevented, and a panel without glittering can be manufactured. With regard to a projector panel, adoption of metal having a high reflectivity as the black matrix can suppress more light leakage to the active layers, since unnecessary light is reflected. In any case, with regard to thresholdless liquid crystal, care should be taken such that unevenness due to the thickness of the black matrix does not influence the orientation of the liquid crystal.

Further, a transparent conductive film 1512 having a function to control the orientation of the liquid crystal by applying an electric field thereto is on the opposing substrate 1511. As the transparent conductive film, ITO or the like may be used. In any case, a material having less surface unevenness is more desirable for orientation of thresholdless liquid crystal. In case ITO having the refractive index of about 2 is used as the transparent conductive film, when the film thickness is set to be 100 nm-120 nm, the transmittance in the range of visible radiation can be made larger due to interference.

Cylindrical spacers (not shown) are formed on the opposing substrate for the purpose of securing a cell gap for the panel. Since the orientation defects of the liquid crystal induced by the spacers tend to become larger as the diameter of the spacers become larger, it is desirable that the diameter of the cylindrical spacers is as small as possible. It is also possible to, by disposing the cylindrical spacers on the contact hole of the pixel electrode of the thin film transistor substrate, cover the unevenness on the surface of the thin film transistor.

The means for securing the cell gap is not limited to the cylindrical spacers, and wall spacers (not shown) may also be adopted for the purpose of preventing the orientation defects of the liquid crystal. By designing such that the wall spacers come to uneven places such as a border between pixel electrodes of the thin film transistor substrate, the unevenness of the surface of the thin film transistor can be covered to make the surface of the oriented liquid crystal as planar as possible. Though the spacer material is patterned and provided on the opposing substrate in this embodiment, the spacer material is not limited to be formed on the opposing substrate, and may be formed on the active matrix substrate.

When an active matrix panel performs color display, it is necessary that a color filter (not shown) is appropriately provided in a direct-view type panel or a projector single plate type panel. However, in this case, since unevenness where color filter resins of different colors overlap each other may induce orientation defects of the liquid crystal, it is necessary to provide overcoating agent on the color filter to sufficiently planarize the surface of the oriented liquid crystal.

An orientation film 1513 is formed by orientation film printing. The thickness of the orientation film is as thin as 60 nm aiming to suppress voltage loss due to the orientation film.

The orientation film is pre-baked, post-baked, and then rubbed. In case of thresholdless liquid crystal, disorder in the fuzz on the rubbing cloth induces orientation defects to lower the black level. Therefore, the conditions with regard to the texture of the rubbing cloth and the number of aging are reviewed to find conditions where satisfactory orientation can be obtained. The results of experiments carried out by the applicant revealed that rubbing cloth of rayon tends to make the rubbed state more even leading to a better black level compared with rubbing cloth of cotton, which is thought to be due to the comparatively ordered fuzz. Further, rubbing cloth that has been aged to some extent tends to have less ravels leading to less orientation defects.

A seal pattern 1514 is formed between the pair of substrates. As the sealing agent, it is desirable that one which can be collapsed to be 1.5-2.0 μm by thermal press process in fabricating the cell is used.

Thresholdless liquid crystal 1515 is injected in the cell. Since the thresholdless liquid crystal has a large viscosity, it takes a lot of time to inject the thresholdless liquid crystal at ordinary temperature. It is desirable that the injection temperature is raised to an isotropic phase temperature or above when the liquid crystal is injected. However, since vacuum heated injection is performed in a high vacuum at a high temperature, components of the liquid crystal having a low viscosity are easily volatized, and thus, there is a possibility that the composition of the liquid crystal itself changes to influence the orientation of the liquid crystal. It is therefore necessary to review the conditions with regard to the program and the injecting method of the vacuum injection, that is, to take every care not to expose the liquid crystal to a high vacuum and a high temperature, and to suppress volatization of components having a low viscosity. In this embodiment, reorienting treatment is performed by injecting the liquid crystal at a temperature which equals or is above the isotropic phase temperature and slowly cooling the liquid crystal after the injection. After the reorientation, the injection port of the liquid crystal is sealed with UV curable resin (not shown).

Then, a flexible printed circuit (FPC) (not shown) is attached, and an external signal is inputted from the FPC to drive the liquid crystal panel. The pixel electrode 1510 connected to the thin film transistor and the pixel electrode 1511 provided on the substrate opposing the thin film transistor apply an electric field to the liquid crystal and the orientation film.

In driving the active matrix panel, when thresholdless liquid is driven, line-sequential driving is performed and image data is written in every scanning line. In the line-sequential driving, time for writing image data is longer than that in the point-sequential driving, and thus, writing current necessary for reversal of spontaneous polarization can be inputted for a long time.

Figure 16:
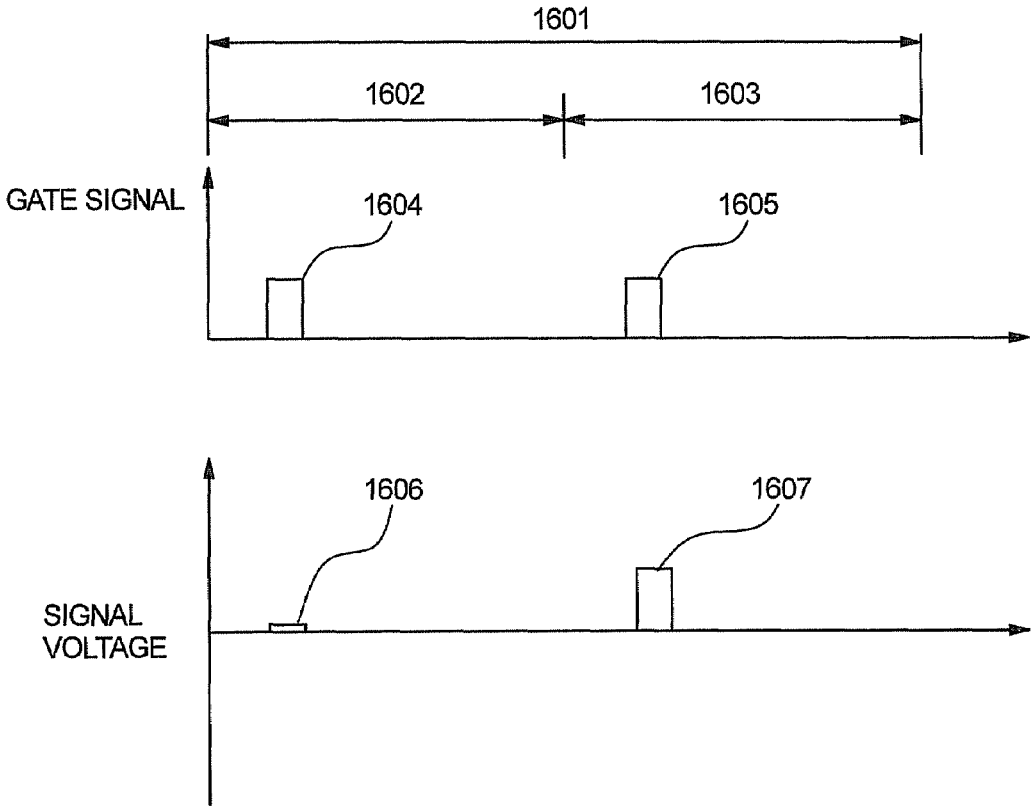
FIG. 16 illustrates a driving waveform in one frame period of the active matrix panel of Embodiment 4.

When a dynamic image is displayed on a liquid crystal panel, one image is written in one frame period of 16.6 msec. FIG. 16 illustrates a driving waveform in one frame period. Two subframes 1602 and 1603 are provided in one frame period 1601 for displaying one image. Both of the two subframes are 8.3 msec. A period 1604 where one scanning line is selected in each of the subframes is, through calculation from the image specification of VGA, 17.2 μsec/line. The first subframe 1602 is the "0 V" reset period, i.e., the first period, and a signal voltage 1606 is 0 V. The second subframe 1603 is the gradation display period, i.e., the second period, and in a period 1605 where the scanning line is selected, a gradation display pulse 1607 having signal voltage corresponding to the image data is inputted from the signal electrode to the respective pixels. In an actual dynamic image display, in the one frame period 1601, the gradation display pulse 1607 corresponding to the image data varies depending on each frame, and a continuous image is formed.

In the cell used in the experiment, the white level of the thresholdless liquid crystal according to Embodiment 4 saturates at the cell voltage of 3.5 V, where the maximum quantity of light is obtained. Before that point, the brightness is increased as the voltage is increased in the voltage-transmittance characteristics curve. However, in the active matrix driving, since the cell voltage (voltage applied to the orientation film and the liquid crystal) and the potential of the auxiliary capacitor are lowered due to the reversal of the spontaneous polarization, the cell voltage is lower than the signal voltage of the thin film transistor. In order to have the cell voltage of 3.5 V, it is necessary that the signal voltage is as high as 6 V. Therefore, the relationship between the signal voltage and the transmittance has more relaxed threshold characteristics than the relationship between the liquid crystal cell voltage and the transmittance, and gradation can be obtained more easily.

Though the liquid crystal is driven using the active matrix panel that is driven by a constant charge with the driving waveform illustrated in FIG. 16 and with the "0 V" reset period being provided, it can be confirmed that the effect of improving the hysteresis which was found in the constant current driving is also present in the active matrix driving. Further, in the active matrix driving with the driving voltage being limited, even if the orientation film thickness is as thin as 60 nm, which is the optimum for preventing voltage loss of the orientation film to achieve a satisfactory white level, the hysteresis is liable to occur, but satisfactory gradation can be obtained.

Though the liquid crystal is driven in the active matrix panel driven by a constant charge with the "0 V" reset period being provided, it can be confirmed that the effect of improving the response time, which was found in the constant current driving, is also present in the active matrix driving. The switching for halftone display in displaying a dynamic image when the "0 V" reset period is provided is smoother than when the "0 V" reset period is not provided, and the effect of improving the response time can be realized.

The present invention can be applied not only to the liquid crystal material, the spontaneous polarization, and the orientation film thickness of the thresholdless liquid crystal according to this embodiment, but can be widely applied.

Further, when liquid crystal is driven with a thin film transistor provided with an auxiliary capacitor, depending on the voltage in the preceding frame, charge stored in a capacitor with a liquid crystal layer being as a dielectric and in the auxiliary capacitor which is connected in series with an active element varies. However, by providing the "0 V" reset period therebetween, charge stored in the preceding frame in the capacitor with the liquid crystal layer being as a dielectric and in the auxiliary capacitor which is connected in series with the active element can be discharged, and irrespective of the voltage in the preceding frame, predetermined gradation can be displayed.

With regard to liquid crystal having a smectic phase, one is known these days which presents a predetermined black level when voltage of a first polarity is applied thereto and which, when voltage of a second polarity is applied thereto, continuously changes the transmittance of a liquid crystal cell according to the voltage. For convenience' sake, such characteristics is herein referred to as Half-V-shaped characteristics. Liquid crystal that presents the Half-V-shaped characteristics includes R2402 (LZ-972) and R2401 (LZ-972) manufactured by Clariant. In the liquid crystal presenting the Half-V-shaped characteristics, reversal of spontaneous polarization does not occur when voltage of the first polarity is applied thereto, and reversal of spontaneous polarization occurs only when voltage of the second polarity is applied thereto. Therefore, so far as liquid crystal having the Half-V-shaped characteristics is used, in alternate current driving, irrespective of the voltage of the first polarity, by injecting a predetermined charge in the capacitor with the liquid crystal layer being as a dielectric, the same gradation can be displayed. In other words, it is not necessary to provide the "0 V" reset period, i.e., the first period, to discharge the charge stored in the auxiliary capacitor and the capacitor with the liquid crystal layer being as dielectric.

In the present invention, when thresholdless liquid crystal is driven with the auxiliary capacitor being connected in series with the active element such as the thin film transistor, by providing the "0 V" reset period, i.e., the first period, charge stored in the auxiliary capacitor and the capacitor with the liquid crystal layer being as a dielectric is discharged. The above description makes it clear that such a structure is particularly effective with regard to, among smectic liquid crystal, liquid crystal the transmittance of which is uniquely determined when voltages having the same absolute value but opposite polarities are applied thereto, for example, thresholdless liquid crystal.

An active matrix substrate and a liquid crystal display device manufactured by implementing the present invention can be used in various electro-optical devices. The present invention can be applied to all electronic apparatus with such electro-optical devices incorporated therein as a display device. Such electronic apparatus include a personal computer, a digital camera, a video camera, a personal information terminal (a mobile computer, a portable telephone, an electronic book, or the like), and a navigation system.

Embodiment 5

In this embodiment, the relationship among the orientation film thickness, the spontaneous polarization of liquid crystal, and the hysteresis was reviewed. In this embodiment, the orientation film thickness was 30 nm, 75 nm, 110 nm, and 220 nm. The orientation film used was RN 1286 manufactured by Nissan Chemical Industries, Ltd.

The orientation film was rubbed under the following conditions: push . . . 0.3 mm; roll revolution . . . 100 rpm; rubbing roll diameter . . . 130 mmΦ; stage speed . . . 10 mm/sec; and number of rubbing . . . once.

As the liquid crystal, MX-Z19 having the spontaneous polarization of 40 nC/cm$^2$ and MX-Y102 having the spontaneous polarization of 100 nC/cm$^2$, both of which are manufactured by Mitsubishi Gas Chemical Company, Inc. were used.

Since the phase transition temperature from an 5 mA (smectic A) phase to an isotropic phase of the liquid crystals MX-Y102 and MX-Z19 is 96° C., the liquid crystal was injected in the isotropic phase at 100° C. Liquid crystal cells were disposed on the surface of a hot plate, and after the liquid crystal was heated and injected therein, the liquid crystal cells were slowly cooled to room temperature at the rate of 1° C./min-2° C./min.

The cell gap was in the range of 1.5 μm±0.5 μm with regard to all the liquid crystal cells.

The liquid crystal cells were driven with a triangular wave having the frequency of 0.1 Hz, using the function generator "MODEL275" manufactured by Waveteck Co. Ltd. This is because, though the hysteresis changes depending on the frequency, it is generally said that the hysteresis observed in driving with a triangular wave having the frequency of 0.1 Hz substantially approximates the hysteresis observed in actual driving of a liquid crystal display device.

Figure 20:
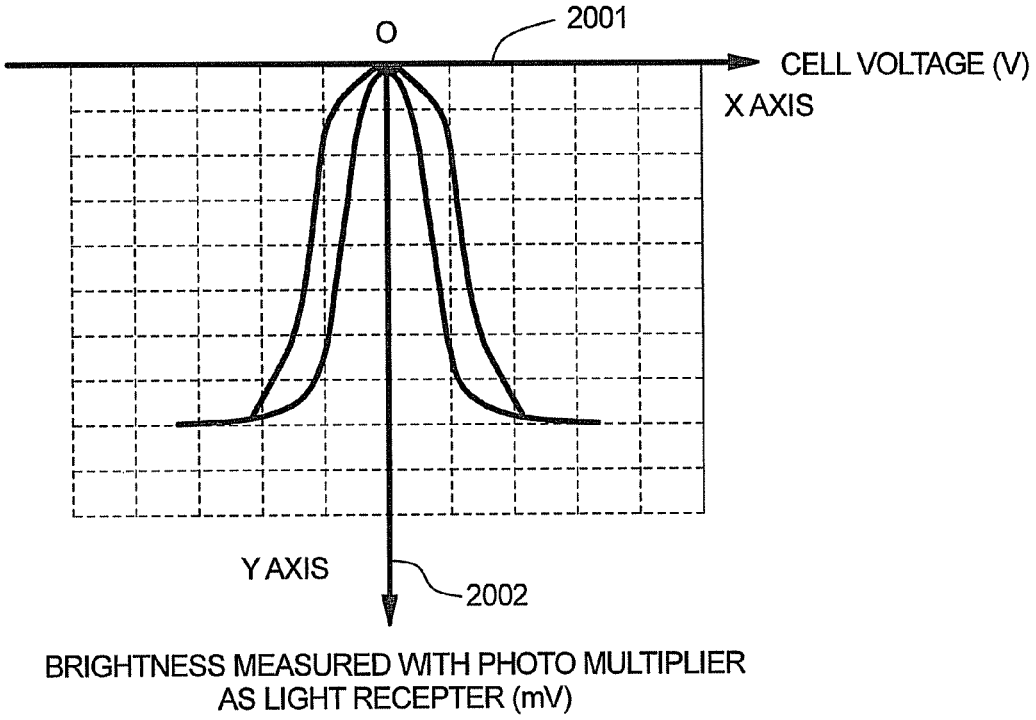
FIG. 20 illustrates description of the relationship between the cell voltage and the transmittance of the liquid crystal cell of FIGS. 18A to 19D of Embodiment 5.

The liquid crystal cells were provided between polarizing plates disposed such that the transmission axis was crossed Nicol, and the electro-optical characteristics when voltage was applied to the liquid crystal cells were measured using a photo multiplier. Data displayed on an oscilloscope is described with reference to FIG. 20. An X axis 2001 shows the cell voltage applied to the liquid crystal cell. A positive value of an X coordinate means that a positive voltage is applied to the liquid crystal cell. A negative value of an X coordinate means that a negative voltage is applied to the liquid crystal cell. A Y axis 2002 shows the quantity of photo electrons converted to voltage which entered the photo multiplier. That is, Y axis 2002 is the brightness measured with the photo multiplier being as a light receptor. It is to be noted that, for convenience sake, the brightness is herein referred to as the transmittance of the liquid crystal cell. When a Y coordinate is 0 mV, it means that the liquid crystal cell displays black and no photoelectron enters the photo multiplier.

With regard to thresholdless liquid crystal, when the absolute value of the voltage applied to the liquid crystal cell gradually increases, due to the effect of birefringence, the transmittance gradually increases until, at some point of the increased applied voltage, the transmittance of the liquid crystal becomes constant. In the experiment, the liquid crystal cell was driven in a range below the voltage where the transmittance of the liquid crystal becomes constant. This is because, if the absolute value of the voltage applied to the liquid crystal is too large, electric energy makes nonuniform the orientation of the liquid crystal.

Figure 18A:
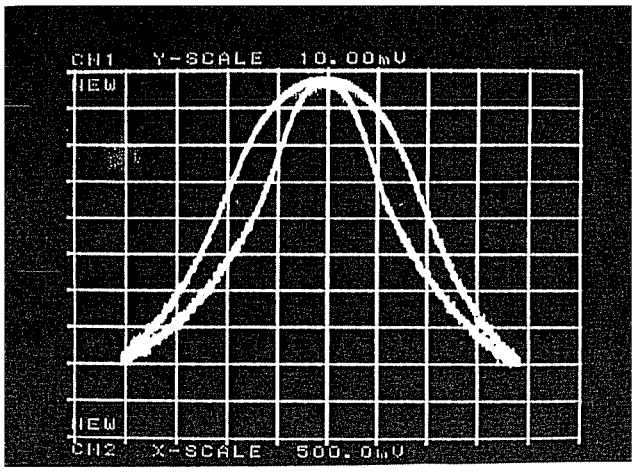
FIGS. 18A to 18D illustrate dependency of the electro-optical characteristics of thresholdless liquid crystal MX-Z19 on the orientation film thickness of Embodiment 5.
Figure 18B:
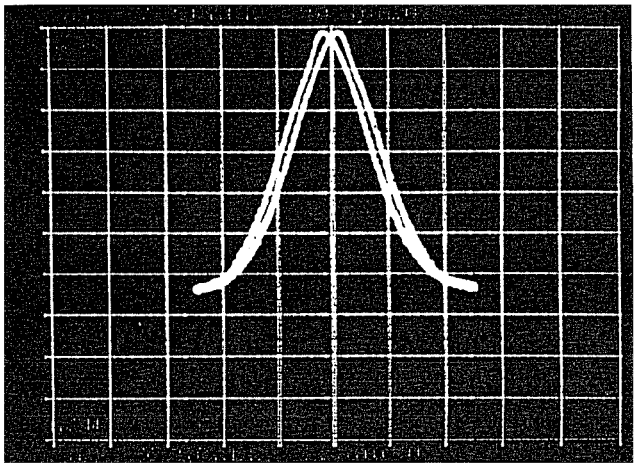
Figure 18C:
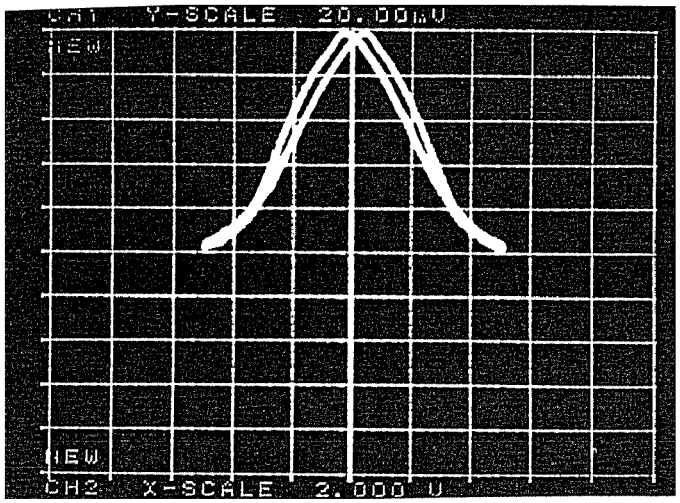
Figure 18D:
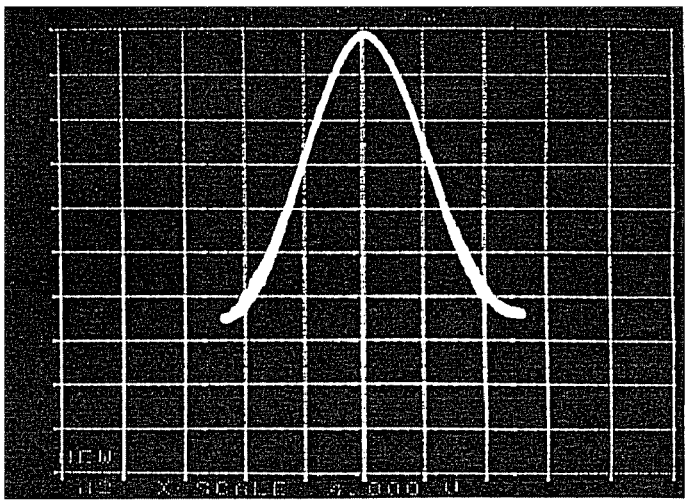

FIGS. 18A to 18D illustrate the electro-optical characteristics of the liquid crystal cells using MX-Z19 having the spontaneous polarization of 40 nC/cm$^2$. In FIG. 18A, the orientation film has a thickness of 30 nm; FIG. 18B, 75 nm; FIG. 18C, 110 nm; and FIG. 18D, 220 nm. Whether the hysteresis occurred or not was confirmed by changing the orientation film thickness. It was found that the hysteresis occurred in the orientation film thickness range of 30 nm-110 nm.

Figure 19A:
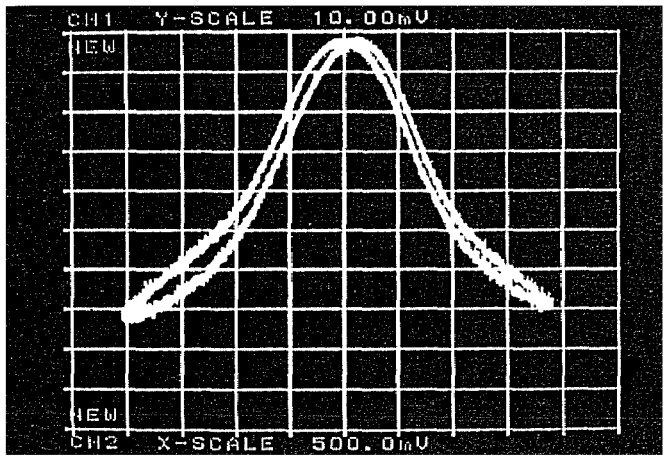
FIGS. 19A to 19D illustrate dependency of the electro-optical characteristics of thresholdless liquid crystal MX-Y102 on the orientation film thickness of Embodiment 5.
Figure 19B:
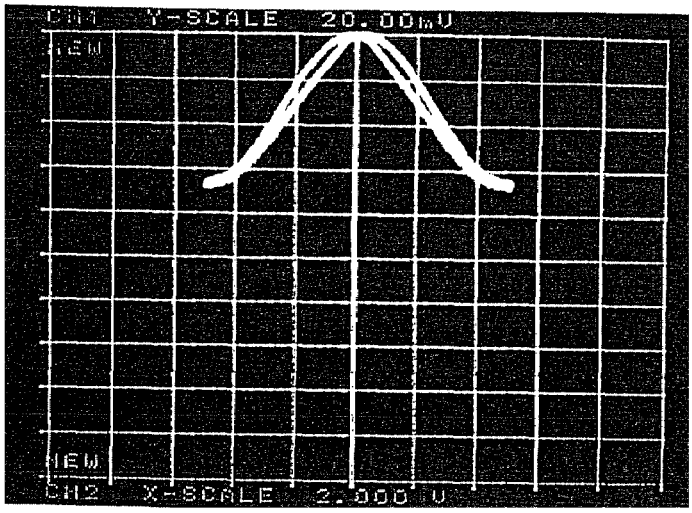
Figure 19C:
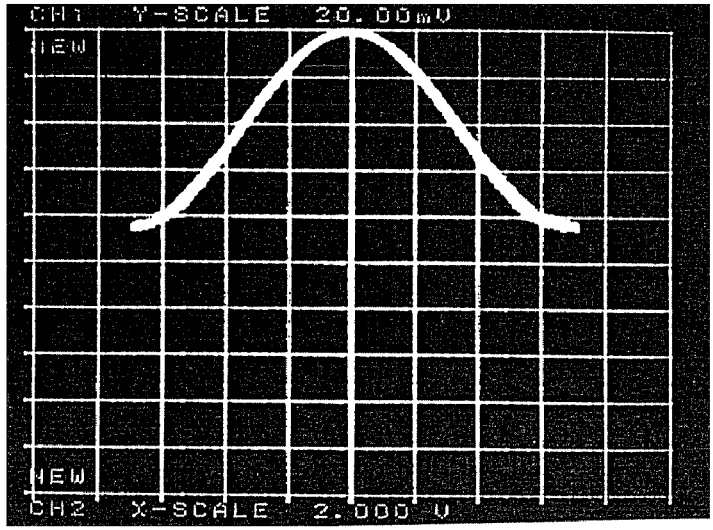

FIGS. 19A to 19D illustrate the electro-optical characteristics of the liquid crystal cells using MX-Y102 having the spontaneous polarization of 100 nC/cm$^2$. In FIG. 19A, the orientation film has a thickness of 30 nm; FIG. 19B, 75 nm; FIG. 19C, 110 nm; and FIG. 19D, 220 nm. It was found that the hysteresis occurred in the orientation film thickness range of 30 nm-75 nm.

Figure 19D:
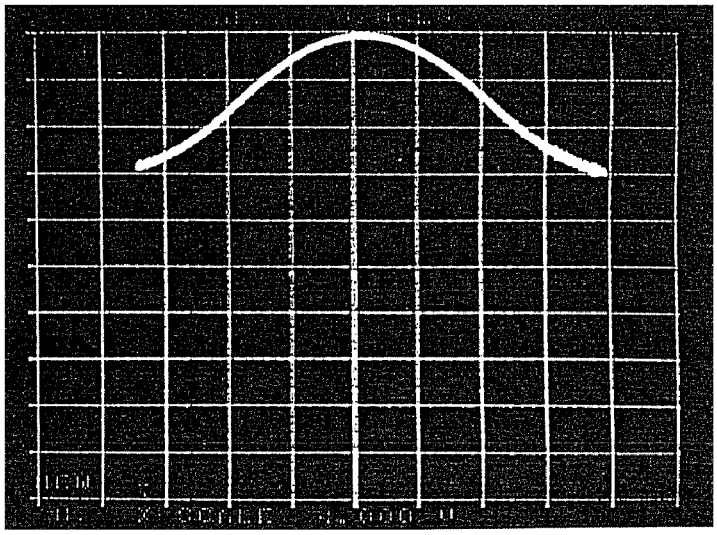

In FIGS. 18A and 19D, the difference in the maximum transmittance of the respective liquid crystal cells is mainly due to the difference in the retardation which itself is due to the difference in the cell gap.

In the experiment, it was found that the hysteresis occurred when the spontaneous polarization of the liquid crystal was 40 nC/cm$^2$-100 nC/cm$^2$ and the orientated layer thickness was in the range of 30 nm-75 nm. Taking into consideration that the hysteresis is more liable to occur when the orientation film thickness is thinner and the spontaneous polarization of the liquid crystal is smaller, it was found that the hysteresis was liable to occur when the orientation film thickness was 75 nm or thinner and the spontaneous polarization of the liquid crystal was 100 nC/cm$^2$ or smaller.

Of course, by providing the first period for applying the voltage of 0 V before or after the second period for applying the voltage in response to the gradation to the liquid crystal according to the present invention, there is an effect of decreasing the hysteresis even with regard to such liquid crystal cells having the orientation film thickness of 75 nm or thinner and having the spontaneous polarization of 100 nC/cm$^2$ or smaller.

What is claimed is:

1. A method of driving a liquid crystal display device,
the liquid crystal display device including:
an orientation film over a substrate; and
a liquid crystal material over the orientation film, said liquid crystal material having a chiral smectic $C_R$ phase,
wherein a brightness of said liquid crystal material increases monotonically according to an increase of a voltage value applied to said liquid crystal material, and
wherein the liquid crystal material has an approximately V-shaped electrooptical characteristic,
the method comprising:
displaying a first black level by the liquid crystal material in a first period;
applying a first voltage to the liquid crystal material for a first gradation display in a second period just after the first period;
displaying a second black level by the liquid crystal material in a third period just after the second period; and
applying a second voltage to the liquid crystal material for a second gradation display in a fourth period just after the second period.

2. A method of driving a liquid crystal display device,
the liquid crystal display device including:
an orientation film over a substrate; and
a liquid crystal material over the orientation film, said liquid crystal material having a chiral smectic $C_R$ phase,
wherein a brightness of said liquid crystal material increases monotonically according to an increase of a voltage value applied to said liquid crystal material, and
wherein the liquid crystal material has an approximately V-shaped electrooptical characteristic,
the method comprising:
canceling out a spontaneous polarization of the liquid crystal material in a first period; and
applying a first voltage to the liquid crystal material for a first gradation display in a second period just after the first period;
canceling out the spontaneous polarization of the liquid crystal material in a third period just after the second period;
applying a second voltage to the liquid crystal material for a second gradation display in a fourth period just after the third period.

3. A method of driving a liquid crystal display device:
the liquid crystal display device including:
an orientation film over a substrate; and
a liquid crystal material over the orientation film, said liquid crystal material having a chiral smectic $C_R$ phase,
wherein a brightness of said liquid crystal material increases monotonically according to an increase of a voltage value applied to said liquid crystal material, and
wherein the liquid crystal material has an approximately V-shaped electrooptical characteristic,
the method comprising:
applying a voltage of 0V to the liquid crystal material in a first period; and
applying a first voltage to the liquid crystal material for a first gradation display in a second period just after the first period,
applying a voltage of 0V to the liquid crystal material in a third period just after the second period;
applying a voltage to the liquid crystal material for a second gradation display in a fourth period just after the third period.

4. A method according to claim 1,
wherein a plurality of active elements are formed over the substrate.

5. A method according to claim 4,
wherein each of the plurality of active elements applies a voltage to the liquid crystal material, and
wherein the voltage has an upper limit.

6. A method according to claim 5,
wherein the upper limit of the voltage has an absolute value of 7 V or less.

7. A method according to claim 1,
wherein a spontaneous polarization of the liquid crystal material is 40 $nC/cm^2$-150 $nC/cm^2$, and
wherein a thickness of the orientation film is 15 nm-75 nm.

8. A method according to claim 1,
wherein a spontaneous polarization of the liquid crystal material is 20 $nC/cm^2$-40 $nC/cm^2$, and
wherein a thickness of the orientation film is 30 nm-150 nm.

9. A method according to claim 1,
wherein a spontaneous polarization of the liquid crystal material is 40 $nC/cm^2$ or less.

10. A method according to claim 1,
wherein a first response time is defined as a response time of the liquid crystal material between a third voltage and a fourth voltage having an opposite polarity to the third voltage not via a voltage of 0V,
wherein a second response time is defined as a response time of the liquid crystal material between the first voltage and the second voltage having an opposite polarity to the first voltage via the voltage of 0V,
wherein the second response time is five times or more as short as the first response time.

11. A method according to claim 4,
wherein each of the plurality of active elements is connected in series to an auxiliary capacitor.

12. A method of driving a liquid crystal display device,
the liquid crystal display device including:
a plurality of thin film transistors being provided over a substrate;
an auxiliary capacitor being connected in series to each of the plurality of thin film transistors;
an orientation film over each of the plurality of thin film transistors; and
a liquid crystal material over the orientation film, said liquid crystal material having a spontaneous polarization and being connected in parallel to the auxiliary capacitor,
wherein a brightness of said liquid crystal material increases monotonically according to an increase of a voltage value applied to said liquid crystal material,
wherein the liquid crystal material has an approximately V-shaped electrooptical characteristic,
the method comprising:
applying a voltage of 0V to the liquid crystal material in a first period through a single thin film transistor of the plurality of thin film transistors; and
performing a first gradation display in a second period through the single thin film transistor just after the first period,
applying a voltage of 0V to the liquid crystal material in a third period through a single thin film transistor of said plurality of thin film transistors just after the second period; and
performing a second gradation display in a fourth period through said single thin film transistor just after the third period.

13. A method according to claim 12,
wherein a transmittance of the liquid crystal material is uniquely determined when voltages having a same absolute value and opposite polarities are applied thereto.

14. A method according to claim 12,
wherein the liquid crystal material has a same tilt angle when voltages having a same absolute value and opposite polarities are applied thereto.

15. A method according to claim 12,
wherein the liquid crystal material has a chiral smectic $C_R$ phase.

16. A method according to claim 1,
wherein a spontaneous polarization of the liquid crystal is 100 $nC/cm^2$ or less, and
wherein the thickness of the orientation film is 75 nm or less.

17. A method according to claim 2,
wherein a plurality of active elements are formed over the substrate.

18. A method according to claim 17,
wherein each of the plurality of active elements applies a voltage to the liquid crystal material, and
wherein the voltage has an upper limit.

19. A method according to claim 18,
wherein the upper limit of the voltage has an absolute value of 7 V or less.

20. A method according to claim 2,
wherein the spontaneous polarization of the liquid crystal material is 40 $nC/cm^2$-150 $nC/cm^2$, and
wherein a thickness of the orientation film is 15 nm-75 nm.

21. A method according to claim 2,
wherein the spontaneous polarization of the liquid crystal material is 20 $nC/cm^2$-40 $nC/cm^2$, and
wherein a thickness of the orientation film is 30 nm-150 nm.

22. A method according to claim 2,
wherein the spontaneous polarization of the liquid crystal material is 40 $nC/cm^2$ or less.

23. A method according to claim 2, wherein a third response time is defined as a response time of the liquid crystal material between a first voltage and a fourth voltage having an opposite polarity to the first voltage not via a voltage of 0V, wherein a second response time is defined as a response time of the liquid crystal material between the first voltage and the second voltage having an opposite polarity to the first voltage via the voltage of 0V, wherein the second response time is five times or more as short as the first response time.

24. A method according to claim 17, wherein each of the plurality of active elements is connected in series to an auxiliary capacitor.

25. A method according to claim 2, wherein the spontaneous polarization of the liquid crystal is 100 $nC/cm^2$ or less, and wherein the thickness of the orientation film is 75 nm or less.

26. A method according to claim 3, wherein a plurality of active elements are formed over the substrate.

27. A method according to claim 26, wherein each of the plurality of active elements applies a voltage to the liquid crystal material, and wherein the voltage has an upper limit.

28. A method according to claim 27, wherein the upper limit of the voltage has an absolute value of 7 V or less.

29. A method according to claim 3, wherein a spontaneous polarization of the liquid crystal material is 40 $nC/cm^2$-150 $nC/cm^2$, and wherein a thickness of the orientation film is 15 nm-75 nm.

30. A method according to claim 3, wherein a spontaneous polarization of the liquid crystal material is 20 $nC/cm^2$-40 $nC/cm^2$, and wherein a thickness of the orientation film is 30 nm-150 nm.

31. A method according to claim 3, wherein a spontaneous polarization of the liquid crystal material is 40 $nC/cm^2$ or less.

32. A method according to claim 3, wherein a third response time is defined as a response time of the liquid crystal material between a first voltage and a fourth voltage having an opposite polarity to the first voltage not via the voltage of 0V, wherein a second response time is defined as a response time of the liquid crystal material between the first voltage and the second voltage having an opposite polarity to the first voltage via the voltage of 0V, wherein the second response time is five times or more as short as the first response time.

33. A method according to claim 26, wherein each of the plurality of active elements is connected in series to an auxiliary capacitor.

34. A method according to claim 3, wherein a spontaneous polarization of the liquid crystal is 100 $nC/cm^2$ or less, and wherein the thickness of the orientation film is 75 nm or less.

35. A method according to claim 1, wherein said liquid crystal material is driven by active matrix driving.

36. A method according to claim 2, wherein said liquid crystal material is driven by active matrix driving.

37. A method according to claim 3, wherein said liquid crystal material is driven by active matrix driving.

38. A method according to claim 1, wherein said black level is displayed by applying a voltage of 0V to the liquid crystal material.

39. A method according to claim 1, wherein a quantity of light changes by changing the voltage value.

40. A method according to claim 2, wherein a quantity of light changes by changing the voltage value.

41. A method according to claim 3, wherein a quantity of light changes by changing the voltage value.

* * * * *